US008331819B2

(12) United States Patent
Fukuzawa et al.

(10) Patent No.: US 8,331,819 B2
(45) Date of Patent: Dec. 11, 2012

(54) IMAGE FORMING APPARATUS

(75) Inventors: Daizo Fukuzawa, Mishima (JP); Tooru Imaizumi, Kawasaki (JP); Mahito Yoshioka, Numazu (JP); Noriaki Sato, Suntou-gun (JP); Munehito Kurata, Suntou-gun (JP); Kuniaki Kasuga, Mishima (JP); Yoshimichi Ikeda, Numazu (JP); Hiromitsu Kumada, Susono (JP); Satoru Koyama, Mishima (JP); Toshifumi Kitamura, Numazu (JP); Atsunobu Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 12/794,404

(22) Filed: Jun. 4, 2010

(65) Prior Publication Data

US 2010/0316404 A1 Dec. 16, 2010

(30) Foreign Application Priority Data

Jun. 11, 2009 (JP) ..... 2009-140246
Jun. 11, 2009 (JP) ..... 2009-140247

(51) Int. Cl.
*G03G 15/20* (2006.01)

(52) U.S. Cl. ..... 399/69

(58) Field of Classification Search ..... 399/67–70
See application file for complete search history.

(56) References Cited

U.S. PATENT DOCUMENTS 5,083,168 A 1/1992 Kusaka et al.
5,148,226 A 9/1992 Setoriyama et al.
5,149,941 A 9/1992 Hirabayashi et al.
5,162,634 A 11/1992 Kusaka et al.
5,262,834 A 11/1993 Kusaka et al.
5,300,997 A 4/1994 Hirabayashi et al.
5,343,280 A 8/1994 Hirabayashi et al.
5,464,964 A * 11/1995 Okuda et al. ..... 219/497
5,767,484 A 6/1998 Hirabayashi et al.
6,853,818 B2 2/2005 Nishida
7,136,601 B2 11/2006 Akizuki et al.
7,206,984 B2 4/2007 Anzou
7,321,738 B2 * 1/2008 Kaji et al. ..... 399/69
7,327,967 B2 2/2008 Mori et al.
7,630,662 B2 12/2009 Namiki et al.
7,792,446 B2 9/2010 Mori et al.
7,831,163 B2 * 11/2010 Tsukada ..... 399/69
(Continued)

FOREIGN PATENT DOCUMENTS

JP 63-313182 A 12/1988
(Continued)

*Primary Examiner* — David Gray
*Assistant Examiner* — Gregory H Curran
(74) *Attorney, Agent, or Firm* — Fitzpatrick, Cella, Harper & Scinto

(57) ABSTRACT

The image forming apparatus includes a fixing portion, a temperature detection element, and a power control portion. The power control portion is capable of setting a first power supply control mode for supplying power according to the detected temperature for each one control cycle, a second power supply control mode for supplying power according to the detected temperature for each one control cycle and a third power supply control mode for supplying predetermined power, and switches, immediately before a leading edge of the recording material enters the fixing portion, a state of supplying the power in the first power supply control mode to a state of supplying the power in the second power supply control mode, and then switches the state of supplying the power in the second power supply control mode to a state of supplying the power in the third power supply control mode.

5 Claims, 22 Drawing Sheets

U.S. PATENT DOCUMENTS

| | | | |
|---|---|---|---|
| 2010/0215391 | A1 | 8/2010 | Namiki et al. |

FOREIGN PATENT DOCUMENTS

| | | | |
|---|---|---|---|
| JP | 2-157878 | A | 6/1990 |
| JP | 4-44075 | A | 2/1992 |
| JP | 4-44076 | A | 2/1992 |
| JP | 9-101718 | A | 4/1997 |
| JP | 9-106215 | A | 4/1997 |
| JP | 10-333490 | A | 12/1998 |
| JP | 11-15303 | A | 1/1999 |
| JP | 2000-268939 | A | 9/2000 |
| JP | 2001-100588 | A | 4/2001 |
| JP | 2003-123941 | A | 4/2003 |
| JP | 2004-78181 | A | 3/2004 |
| JP | 2005-353241 | A | 12/2005 |
| JP | 2009-25831 | A | 2/2009 |

* cited by examiner

TABLE 1
PHASE CONTROL

TABLE 2
COMBINED CONTROL OF
PHASE AND WAVE NUMBERS

IMAGE FORMING APPARATUS

BACKGROUND OF THE INVENTION

1. Field of the Invention

The present invention relates to an image forming apparatus which includes a fixing portion for heating an unfixed toner by heat (heat-fixing), formed on a recording material thereon.

2. Description of the Related Art

As heating devices for a recording material, there are conventionally known various methods and configurations such as a heat-roller method, a hot-plate method, a heat-chamber method, and a film-heating method. Those heating devices all include heating elements (heat members). In order to maintain a temperature of the device at a predetermined temperature (predetermined image fixing temperature), the temperature is controlled by controlling power supply to the heating element.

Among such various conventional heating devices, the heating device of the film-heating type is highly effective and practical.

The heating device of the film-heating type includes a thin heat-resistive film, a driving means (unit) for the film, a heating element fixed and supported in the film, and a pressure member which is disposed oppositely to the heating element and bonds an image bearing surface of a recording material to the heating element through the film. At least during image heating, the film is moved in a forward direction at substantially the same speed as the recording material, which is conveyed in between the film and the pressure member, and the film passes through a nip portion formed as an image heating portion by a pressing portion between the heating element and the pressure member sandwiching the traveling film. A visible image bearing surface of the recording material is accordingly heated by the heating element through the film to fix a visible image by heat. Then, the film passing through the image heating portion is separated from the recording material at a separation point. This is a basic configuration of the heating devices. Such heating devices of a film-heating type can use a heating element having a low heat capacity and a high temperature-increase rate, and a thin film. Thus, power can be saved, and a shortened wait time (quick start) can be achieved. This type of the heating device is advantageous in eliminating various disadvantages of the other conventional heating devices, which is effective.

In recent years, heating devices have been proposed, which reduce uneven toner melting caused by roughness of a recording material by disposing an elastic layer in a heat film.

In temperature control in the heating devices of the film-heating type, in many cases, the output of a thermistor disposed on the heating element is subjected to A/D conversion, and captured by a CPU. Then, based on a comparison result of a detected temperature with a target temperature, referring to a predefined control table, power supply to the heating element is controlled by PID control for performing proportion (P) control, integral (I) control, and differential (D) control.

In this case, the control of power supply to the heating element is performed by turning an AC voltage ON/OFF through a triac. Wave number control or phase control is used for the power supply control. Power is minutely controlled by controlling a power supply ratio, thereby reducing the amplitude of the temperature of the heating element as much as possible.

The wave number control is ON/OFF control for each half wave, in which several waves of an input AC voltage are set as a predetermined cycle (one control cycle), and which wave is turned ON and which wave is turned OFF are determined for each predetermined cycle. In other words, the wave number control is a method of controlling a power supply ratio based on an ON/OFF duty ratio within the predetermined cycle.

For example, one half wave=10 milliseconds is set when a frequency of alternating current power is 50 Hz. When a predetermined cycle is 20 half waves=200 milliseconds=1 cycle, power supplied to the heating element is revised for every 20 half waves. The minimum power is full OFF (20 half waves full OFF), and the maximum power is full ON (20 half waves full ON). The amount of power supplied for each cycle is divided into 21 levels where 0 half wave to 20 half waves are ON.

In this control, when a waveform of the input AC voltage is as illustrated in FIG. 10, as an example, a current supplied to the heating element has a waveform illustrated in FIG. 11.

The phase-control method is a method of controlling a power supply angle within one wave of the input AC voltage. A current supplied to the heating element has a waveform illustrated in FIG. 12.

In the wave-number control method, the harmonic current is small while flicker noise is large. In the phase-control method flicker noise is small, while the harmonic current is large.

In wave number control, the power supply ratio is controlled for each predetermined cycle of several waves, and hence a revising cycle must be prolonged to increase the contained number of waves in order to minutely control the power supply ratio. However, the power supply ratio is permitted to be revised for each predetermined cycle. Thus, when the revising cycle is excessively long, switching of the power supply ratio is delayed, disabling supply of appropriate power when necessary. Hence, the power supply ratio and the revising cycle must be set to be balanced with each other.

In phase control, one control cycle is one half wave and hence the power supply ratio is minutely controlled within one half wave, and the power supply ratio is revised for each one full wave at the minimum. Thus, in phase control, the power supply ratio, and more specifically, the power, can be revised more minutely, and temperature ripples of the heating element accompanying the control can be reduced. However, costs of the apparatus are higher in the case of phase control because a noise filter is necessary and a circuit configuration is complex. On the other hand, wave number control has no such cost increase.

Thus, the control is chosen according to apparatus requirements. In particular, in a recent case of using a commercial power source of 200 V, not the phase control but the wave number control is often employed in order to reduce the harmonic current.

Under those circumstances, for example, as disclosed in Japanese Patent Application Laid-Open No. H10-333490, there has been proposed an apparatus configured to switch wave number control and phase control between 200 V and 100 V according to an input AC voltage.

A method has been proposed, which combines phase control and wave number control, in which the phase control is used for at least one half wave within a revising cycle of the wave number control so that a harmonic current is reduced more than when only the phase control is used, and the revising cycle of a power supply ratio is set shorter than when only the wave number control is used to perform more minute control. As an example, refer to Japanese Patent Application Laid-Open No. 2003-123941.

In the heating devices of the film-heating type, especially in a device which includes an elastic layer in the heat film, entry of the recording material into a heat nip portion may be accompanied by an unstable heating state of the recording material. The unstable state occurs because, if the recording material enters a stable temperature state, heat is suddenly absorbed by the recording material immediately after the entry of the recording material into the heat nip, causing a sharp reduction in heat film temperature, and overshoot occurs subsequently when the temperature increases, resulting in great temperature fluctuation of the heat nip.

With regard to the improvement of this phenomenon, the inventors of the present invention have disclosed a method of correcting power supplied to the heating element before temperature fluctuation occurs due to the entry of the recording material in Japanese Patent Application Laid-Open No. 2004-078181.

After the entry of the recording material into the heat nip has been accompanied by the sharp reduction in temperature of the heat film, the temperature is kept low when this portion comes into contact with the recording material again after one rotation of the heat film. More specifically, a phenomenon occurs where the temperature of the heat film drops in a portion corresponding to second rotation of the heat film on the recording material, and image glossiness declines. Meanwhile, it is only an instant immediately after the entry of the recording material causing a sudden change of the heat state that the entry of the recording material causes a large reduction in temperature of the heat film. By the PID control, the heat state is soon stabilized to a certain level, and the temperature reduction is eliminated. Thus, it is only at a portion corresponding to a leading edge of the second rotation that image glossiness declines in the portion corresponding to the second rotation of the heat film on the recording material.

There is a great difference in image glossiness between the portion corresponding to the leading edge of the second rotation of the heat film and a portion corresponding to a trailing edge of the first rotation thereof, and hence a glossiness difference may clearly appear as a step on the boundary. This phenomenon is conspicuous especially when glossy paper is passed through the nip.

In order to reduce the glossiness difference, the power correction must be minutely controlled so that glossiness can be equal at joint portions of the first rotation and the second rotation. More specifically, the temperature reduction of the heat film in the portion corresponding to the leading edge of the second rotation must be complemented so that temperatures can be equal at the leading edge of the second rotation and the trailing edge of the first rotation even if heat is removed at the leading edge of the first rotation.

A mechanism of complementing the temperature reduction based on the power correction is as follows. First, the entry of the recording material causes a reduction in temperature of a heat film surface. Unless power correction is performed, as described above, the temperature of this portion is kept low, and a glossiness difference occurs after one rotation of the heat film. When power correction is performed to forcibly input predetermined power before the entry of the recording material, even if the temperature of the heat film surface drops once, the power forcibly input during one rotation, specifically, heat energy, is conducted to the heat film surface. The temperature reduction is canceled, and a predetermined temperature is restored when the leading edge of the second rotation of the heat film corresponding to the recording material entering portion of the heat film comes into contact with the recording material again.

As is obvious from this mechanism, a portion where the heat generated by the power correction warms an inner surface of the heat film must substantially completely match the portion where the entry of the recording material has caused the reduction in temperature.

Such a case requires accuracy stricter than when the temperature control is simply stabilized. In particular, in the case of a recording material such as glossy paper, sensitivity of glossiness to a temperature is very high, and only a slight temperature difference appears as a glossiness difference, more specifically, a step of glossiness in this case. Hence, the control width of a desirable surface temperature is very small.

In order to set the temperatures of the trailing edge of the first rotation to be equal to the leading edge of the second rotation, power correction for accurately compensating for the temperature reduction at the leading edge of the second rotation must be performed. High accuracy is required not only for setting the power, but also for timing of the power correction. This is because the step in the temperature occurs in accordance with a delta function and, in order to complement the temperature reduction so as to prevent the occurrence of the step, the power must be changed in a complementary manner at an accurate timing of a delta function with respect to timing of the occurrence of the step.

When power correction timing shifts even slightly from the appropriate correction timing, the temperature reduction cannot be adequately compensated for due to a shortage of power or due to excessively input power, causing a problem of hot offset. In other words, when timing of starting power correction shifts even slightly, effects of the power correction are reduced.

However, in the apparatus which employs the wave number control, correction cannot be performed at a timing to perform power correction in response to the entry of the recording material, and temperature fluctuation caused by the entry of the recording material cannot be sufficiently reduced.

The above-mentioned problems occur for the following reason. The revising cycle of the power supply ratio of the wave number control comprises several waves, and hence the revised frequency is small. Thus, there is almost no case where the revised timing matches the power correction timing.

FIG. 13 is a timing chart illustrating revising cycles of power supply ratios of wave number control and phase control and timing of recording material entry and power correction.

In this example, the revising cycle of a power supply ratio of the wave number control is 20 half waves. The timing charts show revised timing A of a power supply ratio of the wave number control, and revised timing B of a power supply ratio of the phase control. Power correction is performed at timing C, and a recording material enters the heat nip at timing D. In the example of FIG. 13, power correction is started 130 milliseconds before the entry of the recording material into the heat nip, and the power control is finished 30 milliseconds after the entry of the recording material into the heat nip.

In the wave number control, the revising cycle of the power supply ratio is long, and hence the shift of the timing for actual correction from the appropriate correction timing is large. In the illustrated example, the power supply ratio is controlled by 20 half waves, and hence there is a shift (delay) of a maximum of 20 milliseconds (in the case of 50 Hz) from issuance of a power correction start command to the actual execution of correction. In this case, the power correction period is 160 milliseconds, which is the sum of 130 milliseconds before the entry of the recording material and 30 milliseconds after the entry. Thus, when there is a maximum shift, power correction is started after the time of a power correction stop. More specifically, in actuality, a command of a power correction stop is issued before a power correction start, and hence no power correction is performed.

In the above-mentioned example, the power supply ratio is changed after the command of the power correction start is issued, and hence a shift of timing is in a direction where execution of correction is always delayed. On the other hand, the start timing of the power correction is known beforehand, and hence the maximum amount of shift can be somewhat reduced by performing correction when the revised timing of the power supply ratio comes at the closest timing before/after the start timing of the power correction based on the assumption of a shift. Even in this case, however, the amount of shift is ±100 milliseconds at a maximum with respect to appropriate power correction timing.

FIGS. 14 to 16 illustrate temperature states of the heat film surface when such a timing shift occurs. In a graph of each of FIGS. 14 to 16, a horizontal axis indicates time, and a vertical axis indicates a surface temperature of the heat film. FIG. 14 illustrates a case where power correction is performed at the appropriate timing. FIG. 15 illustrates a case where a power correction start shifts before the appropriate timing. FIG. 16 illustrates a case where a power correction start shifts after appropriate timing. The entry of the recording material into the heat nip causes a reduction in temperature of the heat film. In FIG. 14, the difference in surface temperature of the heat film before and after the entry of the recording material into the heat nip is suppressed to about Δ2 deg. In FIG. 15, the difference in surface temperature of the heat film before and after the entry of the recording material into the heat nip is Δ8 deg because the surface temperature greatly increases before the entry of the recording material into the heat nip. In FIG. 16, the difference in surface temperature is about Δ8 deg because the entry of the recording material into the heat nip causes a great reduction in surface temperature.

As is obvious from FIG. 15, when power correction is performed at a shifted timing, if correction is performed before the appropriate timing, the temperature of the heat nip increases too greatly, causing excessive heating. When the recording material bearing a toner image enters the nip, toner is melted excessively to generate a hot offset phenomenon. High power is supplied before the appropriate timing, and hence the temperature of the heat film becomes too high until the entry of the recording material, and the glossiness of the recording material becomes higher in a portion corresponding to a trailing edge of the first rotation of the film. Thus, a horizontal strip of uneven brightness occurs so as to emphasize a step (a difference in glossiness) between the trailing edge of the first rotation and the leading edge of the second rotation. On the other hand, if correction is performed after the appropriate timing as illustrated in FIG. 16, the reduction in the amount of heat caused by the entry of the recording material into the nip cannot be compensated for, greatly reducing the temperature. In this case, the glossiness of a portion corresponding to the second rotation of the heat film becomes too low, resulting in an uneven brightness where a step between the trailing end of the first rotation and the leading edge of the first rotation is clearly observed.

In order to deal with the problem, the revising cycle of the power supply ratio may be shortened. In such a case, the number of waves within the revising cycle is reduced, disabling minute setting of the power supply ratio, and temperature control is hindered.

Needless to say, a timing shift occurs also in the case of the phase control. A value of the shift is 1 full wave=20 milliseconds (in the case of 50 Hz) at a maximum. Even with a shift of this level, the influence is not necessarily nil. The inventors of the present invention have conducted a study, and found that uneven brightness is somehow within a permissible range with this amount of shift. In other words, unless the phase control is used, a level which permits a timing shift cannot be set.

However, the phase control has a problem of generating a harmonic current, and hence the phase control cannot always be employed as described above. Moreover, since Europe belongs to a 200 V zone and has strict rules on harmonic currents, the phase control cannot be used, and therefore wave number control must be used.

In the control in which the phase control is used for at least one half wave within a revising cycle of the wave number control of a power supply ratio, the revising cycle of the power supply ratio can be shortened, and thus there are some improvement effects for addressing the problem. However, if the number of waves within the revising cycle is reduced in order to shorten the revising cycle of the power supply ratio, the number of waves for performing the phase control relatively increases, increasing harmonic currents. If this phenomenon is prevented, the power supply ratio cannot be set minutely. A permissible level is reached only by using the phase control for all of the cycles as described above, and hence there is a limit on improvement.

SUMMARY OF THE INVENTION

The present invention has been made in view of the above-mentioned problems, and has an object of providing a technology of performing power correction at an appropriate timing by reducing the shift between the timing of performing power correction before a recording material enters a heat nip and the timing of a revising cycle of a power supply ratio.

Another object of the present invention is to provide an image forming apparatus, comprising a fixing portion that heat-fixes an unfixed toner image formed on a recording material onto the recording material, the fixing portion comprising an endless belt; and a heater that contacts an inner surface of the endless belt and generates heat by power supplied from a commercial alternating current power source; a temperature detection element that detects a temperature of the fixing portion; and a power control portion that controls the power supplied from the commercial alternating current power source to the heater according to the temperature detected by the temperature detection element. The power control portion is capable of setting a first power supply control mode, with a predetermined number of half waves more than two continuous waves in an alternating current waveform set as one control cycle, for supplying power to the heater according to the detected temperature for each one control cycle, a second power supply control mode, with a predetermined number of half waves equal to or less than the two continuous waves in the alternating current waveform set as one control cycle, for supplying power to the heater according to the detected temperature for each one control cycle, and a third power supply control mode for supplying predetermined power to the heater. The power control portion switches, immediately before a leading edge of the recording material enters the fixing portion, a state of supplying the power in the first power supply control mode to a state of supplying the power in the second power supply control mode, then switches the state of supplying the power in the second power supply control mode to a state of supplying the power in the third power supply control mode, and further switches the state of supplying the power in the third power supply control mode to the state of supplying the power in the first power supply control mode. The fixing portion fixes the unfixed toner image onto the recording material in the state of supplying the power to the heater in the first power supply control mode.

Further features of the present invention will become apparent from the following description of exemplary embodiments with reference to the attached drawings.

DESCRIPTION OF THE EMBODIMENTS

Exemplary embodiments of the present invention are now described.

Hereinafter, exemplary embodiments of the present invention are fully described by way of examples with reference to the accompanying drawings. However, sizes, materials, configurations, and relative positional relationships of components described in the exemplary embodiments may be appropriately changed according to configurations and/or various conditions of devices to which the present invention is applied, and it is not intended that the present invention is limited to such exemplary embodiments.

First Exemplary Embodiment

Figure 1:
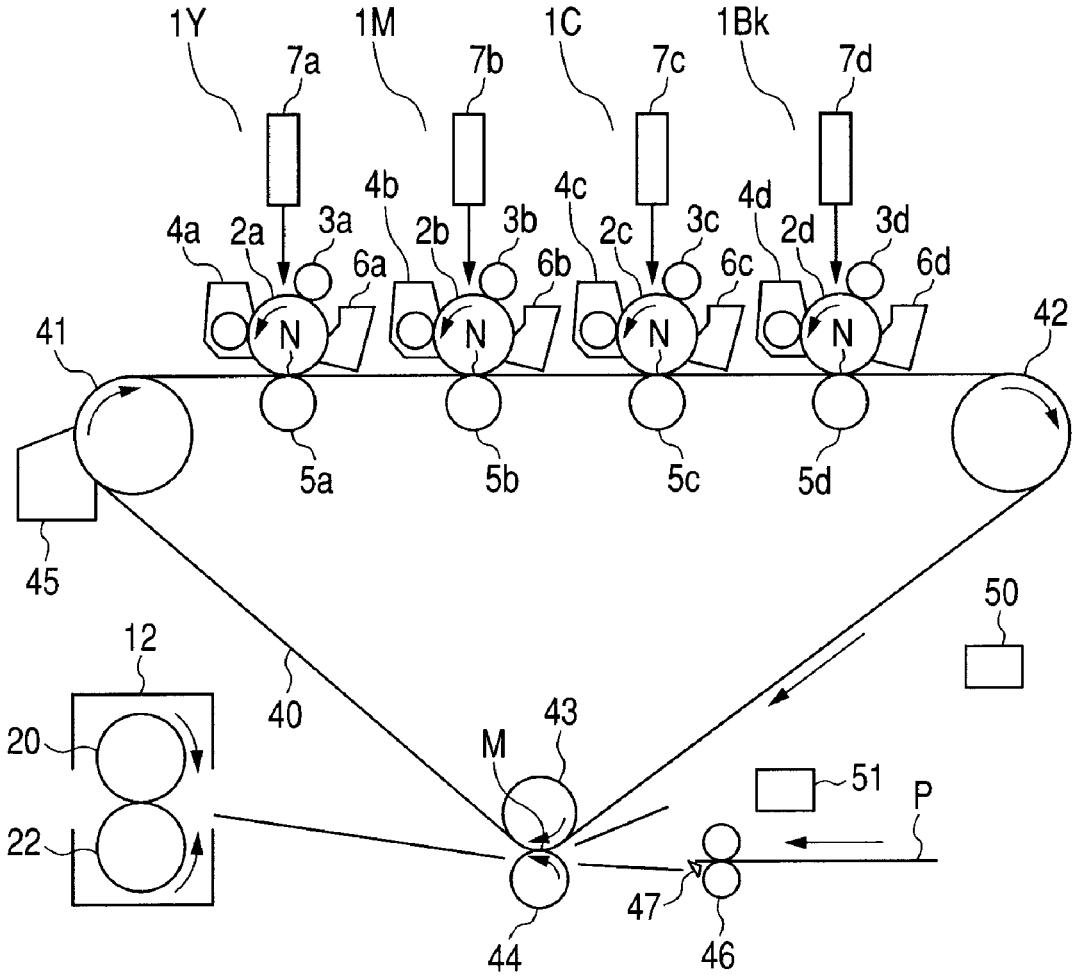
FIG. 1 schematically illustrates a configuration of a color image forming apparatus according to first and second exemplary embodiments.

FIG. 1 schematically illustrates a configuration of a color image forming apparatus according to a first embodiment of the present invention. The image forming apparatus according to this exemplary embodiment is a tandem type electrophotographic full-color printer.

The image forming apparatus includes four image forming portions, i.e. an image forming portion 1Y for forming an yellow image, a magenta image forming portion 1M, a cyan image forming portion 10, and a black image forming portion 1Bk, and those four image forming portions are arranged in a line with a predetermined distance therebetween.

The respective image forming portions 1Y, 1M, 1C, and 1Bk include respective photosensitive drums 2*a*, 2*b*, 2*c*, and 2*d*. Around the respective photosensitive drums 2*a*, 2*b*, 2*c*, and 2*d*, there are disposed, respectively charging rollers 3*a*, 3*b*, 3*c*, and 3*d*, developing devices 4*a*, 4*b*, 4*c*, and 4*d*, transfer rollers 5*a*, 5*b*, 5*c*, and 5*d*, and drum cleaning devices 6*a*, 6*b*, 6*c*, and 6*d*. Further, exposing devices 7*a*, 7*b*, 7*c*, and 7*d* are disposed above and between the charging rollers 3*a*, 3*b*, 3*c*, and 3*d* and the developing devices 4*a*, 4*b*, 4*c*, and 4*d*, respectively. The developing devices 4*a*, 4*b*, 4*c*, and 4*d* contain yellow toner, magenta toner, cyan toner, and black toner, respectively.

An endless belt type intermediate transfer belt 40 as a transfer medium abuts against respective primary transfer portions N of the respective photosensitive drums 2*a*, 2*b*, 2*c*, and 2*d* of the image forming portions 1Y, 1M, 1C, and 1Bk. The intermediate transfer belt 40 is stretched among a driving roller 41, a support roller 42, and a secondary transfer counter roller 43 and is rotated (shifted) by the driving roller 41 in a direction shown by the arrow (clockwise direction).

The respective transfer rollers 5*a*, 5*b*, 5*c*, and 5*d* for primary transfer abut against the respective photosensitive drums 2*a*, 2*b*, 2*c*, and 2*d* with the interposition of the intermediate transfer belt 40 at the respective primary transfer nip portions N.

The secondary transfer counter roller 43 abuts against a secondary transfer roller 44 with the interposition of the intermediate transfer belt 40, to thereby define a secondary transfer portion M. The secondary transfer roller 44 is provided so as to contact and be spaced apart from the intermediate transfer belt 40.

On the outside of the intermediate transfer belt 40, in the vicinity of the driving roller 41, there is provided a belt cleaning device 45 for removing and collecting transfer residual toner remaining on a surface of the intermediate transfer belt 40.

Further, a heating device 12 is disposed on a downstream side of the secondary transfer portion M in a conveying direction of a recording material P.

Further, an environmental sensor 50 and a media sensor 51 are provided within the image forming apparatus. When an image forming operation start signal (print start signal) is issued, the respective photosensitive drums 2*a* to 2*d* of the image forming portions 1Y, 1M, 1C, and 1Bk which are rotated at a predetermined process speed are uniformly charged by their respective charging rollers 3*a* to 3*d* to a have negative polarity in this exemplary embodiment.

The exposing devices 7*a* to 7*d* convert input color-separated image signals into light signals in respective laser output portions (not shown) and laser beams corresponding to the converted light signals are scanned on the charged photosensitive drums 2*a* to 2*d* for exposure, to thereby form electrostatic latent images.

First, on the photosensitive drum 2*a* on which the electrostatic latent image has been formed, yellow toner is electrostatically adsorbed onto the latent image according to a charging potential on the surface of the photosensitive member by means of the developing device 4*a* to which developing bias having the same polarity as the charging polarity (negative polarity) of the photosensitive drum 2*a* is applied, to thereby visualize the electrostatic latent image as a developed image. The yellow toner image is primarily transferred onto the rotating intermediate transfer belt 40 by the transfer roller 5*a* to which primary transfer bias (polarity opposite to the toner (positive polarity)) is applied at the primary transfer portion N. The intermediate transfer belt 40 to which the yellow toner image has been transferred is rotated toward the image forming portion 1M.

Also in the image forming portion 1M, a magenta toner image formed similarly on the photosensitive drum 2*b* is transferred at the primary transfer portion N so that the magenta toner image is superimposed with the yellow toner image on the intermediate transfer belt 40.

Similarly, a cyan toner image formed on the photosensitive drum of the image forming portion 10 and a black toner image formed on the photosensitive drum of the image forming portion 1Bk are successively superimposed with the yellow and magenta toner images transferred and superimposed on the intermediate transfer belt 40 at the primary transfer portions N, to thereby form a full-color toner image on the intermediate transfer belt.

The recording material P is fed/conveyed by a sheet feeding mechanism (not shown). Then, when a registration sensor 47 detects a leading edge position thereof, the conveying is stopped in this state. The recording material P is held by registration rollers 46 and enters a stand-by, waiting state.

Synchronously with timing at which a leading edge of the full-color toner image on the intermediate transfer belt 40 is shifted to the secondary transfer portion M, the recording material (transfer material) P is conveyed, by means of the registration rollers 46, to the secondary transfer portion M. Then, the full-color toner image is collectively secondarily transferred onto the recording material P by the secondary transfer roller 44 to which a secondary transfer bias (polarity opposite to the toner (positive polarity)) is applied.

The recording material P on which the full-color toner image has been formed is conveyed to the heating device 12, where the full-color toner image is heated and pressurized at a heat nip portion between a heat film 20 and a pressure roller 22 to fuse and fix the toner image onto the surface of the recording material P. Thereafter, the recording material is discharged out of the image forming apparatus as an output image from the image forming apparatus. Then, the series of image forming operations are finished.

It should be noted that the environmental sensor 50 is provided within the image forming apparatus so that the fixing condition and biases of the charging, the developing, the primary transfer, and the secondary transfer operations can be changed according to the environments (temperature and humidity) within the image forming apparatus, and the environmental sensor is used for adjusting the density of the toner image formed on the recording material P and for achieving optimal transferring and fixing conditions. Further, the media sensor 51 is provided within the image forming apparatus so that the transfer bias and the fixing condition can be changed according to the recording material by discriminating the recording material P, and is used for achieving the optimal transferring and fixing conditions for the recording material P.

Upon the above-mentioned primary transfer, the primary transfer residual toner remaining on the photosensitive drums 2*a*, 2*b*, 2*c*, and 2*d* is removed and collected by the drum cleaning devices 6*a*, 6*b*, 6*c*, and 6*d* respectively. Further, the secondary transfer residual toner remaining on the intermediate transfer belt 40 after the secondary transfer is removed and collected by the belt cleaning device 45.

Figure 2:
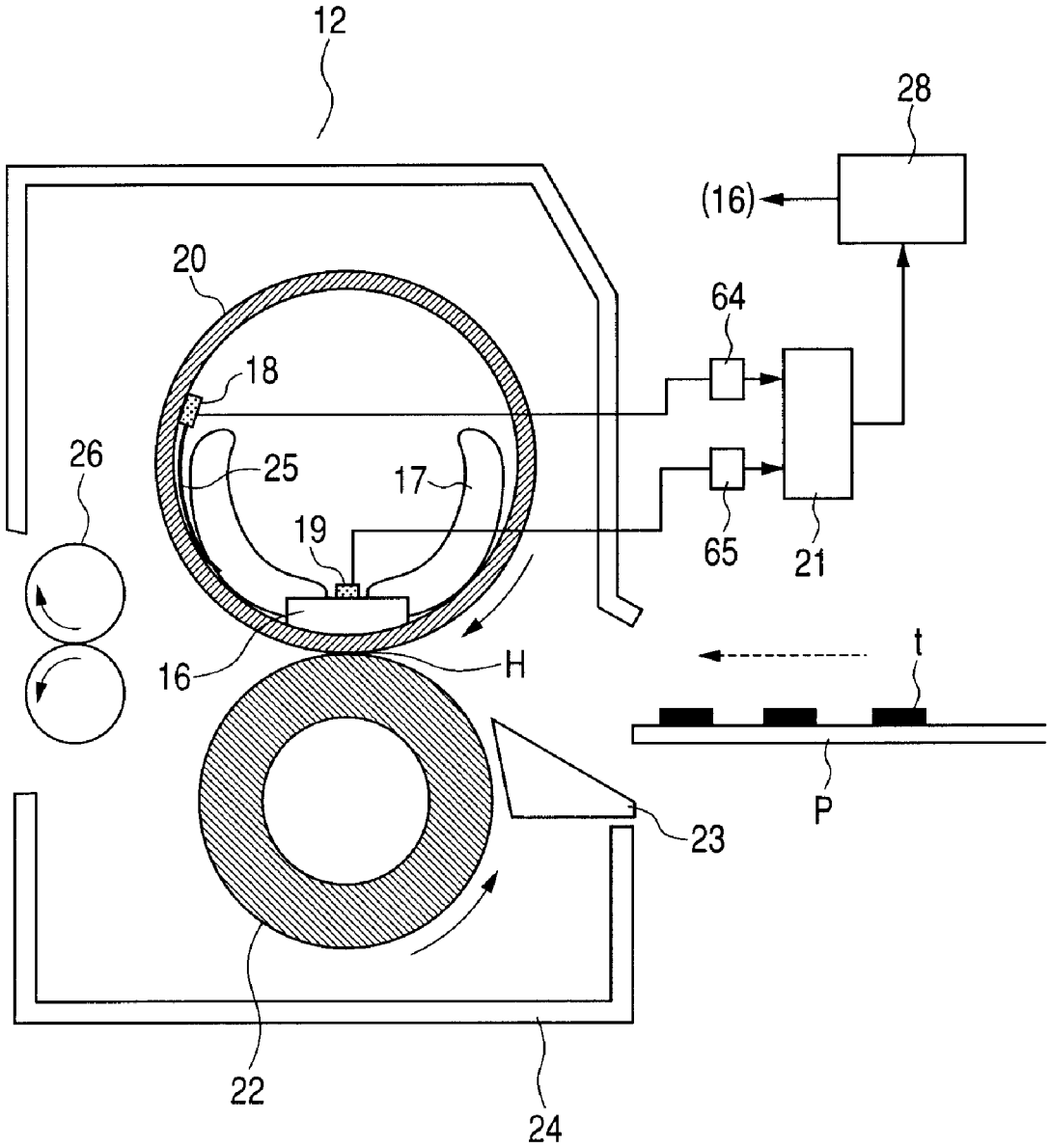
FIG. 2 is a sectional view illustrating a heating device according to the first and second exemplary embodiments.

FIG. 2 schematically illustrates a configuration of the heating device 12 according to this exemplary embodiment. The heating device 12 of this exemplary embodiment is a heating device of a film-heating type and a pressurizing rotary-member driving type (tensionless type).

The heat film 20 serves as a first rotary member (first fixing member) and is a cylindrical (endless belt and sleeve-shaped) member in which an elastic layer is provided on a film.

The pressure roller 22 serves as a second rotary member (second fixing member). A heater holder 17 serves as a heating element holding member and has a substantially half circular gutter cross-section with heat resistance and rigidity, and a heater 16 serves as a heating element (heat source) and is provided on a lower surface of the heater holder 17 along a longitudinal direction of the heater holder. The heat film 20 is loosely mounted around the heater holder 17.

The heater holder 17 is formed from a liquid crystal polymer resin having high heat resistance and serves to hold the heater 16 and to guide the heat film 20. In this exemplary embodiment, as the liquid crystal polymer, Zenight 7755 (product name) manufactured by Du Pont Corporation is used. The maximum usable temperature of the Zenight 7755 is about 270° C.

The pressure roller 22 is constituted by forming a silicone rubber layer having a thickness of about 3 mm on a stainless steel core by injection molding and by coating a PFA resin tube having a thickness of about 40 μm on the silicone rubber layer. The pressure roller 22 is rotatably mounted by supporting both ends of the core between front and rear side plates (not shown) of a device frame 24 through bearings. A heat film unit including the heater 16, heater holder 17, and the heat film 20 is disposed above the pressure roller 22 in parallel with the pressure roller 22 with the heater 16 facing downwardly. Then, both ends of the heater holder 17 are biased by means of a pressure mechanism (not shown) with total pressure of 196 N (20 kgf) (one side: 98 N (10 kgf)) toward an axis of the pressure roller 22. Therefore, the lower surface of the heater 16 is urged, with the interposition of the heat film 20, against the elastic layer of the pressure roller 22 with a predetermined urging force in opposition to elasticity of the elastic layer, to thereby form a heat nip portion H having a predetermined width required for thermal fixing. The pressure mechanism includes a pressure releasing mechanism which can release the pressure to facilitate the removal of the recording material P, for example, at the time of handling a recording material jam.

There are also provided a main thermistor 18 as a first temperature detection unit and a sub thermistor 19 as a second temperature detection unit. The main thermistor 18 as the first temperature detection unit is disposed so as not to contact the heater 16 as the heating element, and, in this exemplary embodiment, the main thermistor 18 is elastically contacted with the inner surface of the heat film 20 above the heater holder 17 to detect the temperature of the inner surface of the heat film 20. The sub thermistor 19 as the second temperature detection unit is disposed near the heater 16 as a heat source compared to the main thermistor 18, and, in this exemplary embodiment, the sub thermistor 19 contacts a rear surface of the heater 16 to detect the temperature of the rear surface of the heater 16.

The main thermistor 18 is attached to a tip end of a stainless steel arm 25 fixedly supported by the heater holder 17 so that the main thermistor 18 is always contacted with the inner surface of the heat film 20 by elastically rocking the arm 25 even if movement of the inner surface of the heat film 20 becomes unstable.

Figure 3:
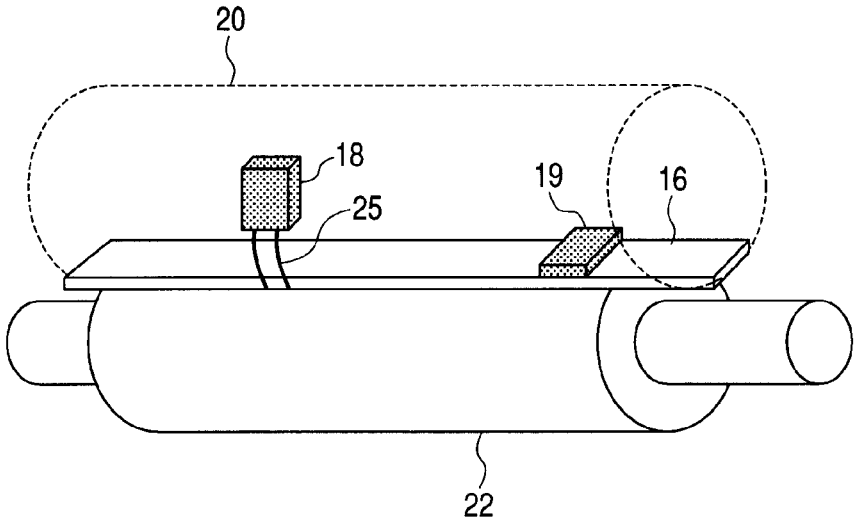
FIG. 3 is a perspective view illustrating a positional relationship among a heater, a main thermistor and a sub thermistor according to the first and second exemplary embodiments.

FIG. 3 is a perspective view illustrating the positional relationship among the heater 16, the main thermistor 18, and the sub thermistor 19 in the heating device according to this exemplary embodiment. The main thermistor 18 is disposed in the vicinity of a longitudinal center of the heat film 20 to contact with the inner surface of the heat film 20, and the sub thermistor 19 is disposed in the vicinity of an end of the heater 16 to contact the rear surface of the heater 16.

Figure 4:
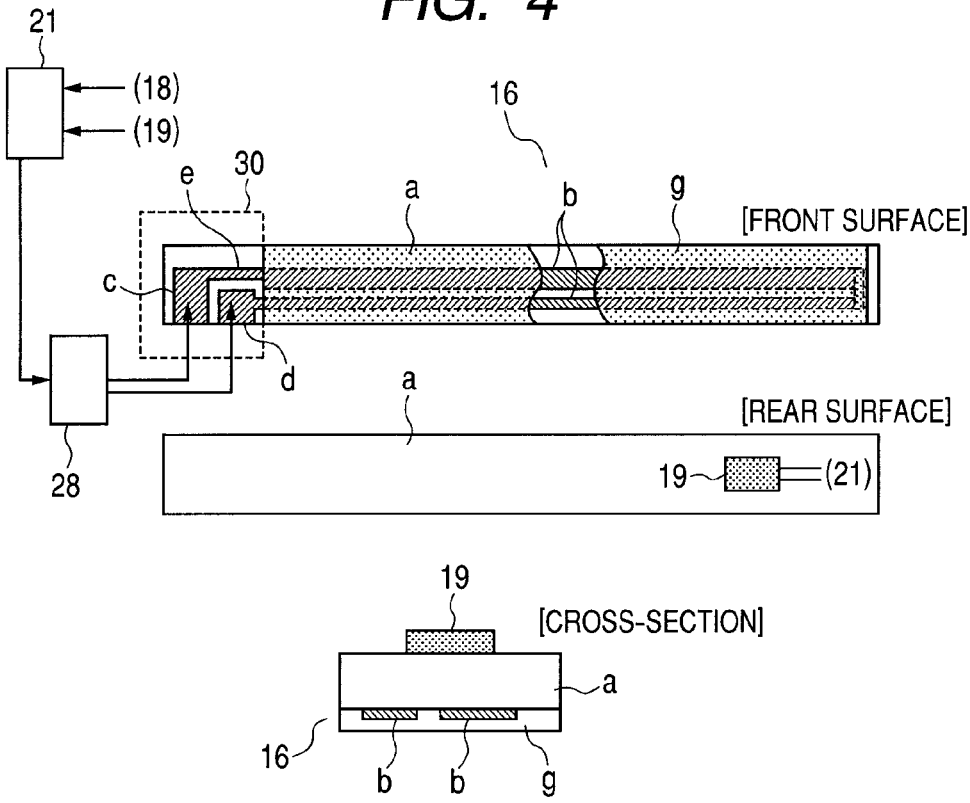
FIG. 4 illustrates a configuration of a ceramic heater serving as a heating element.
Figure 5:
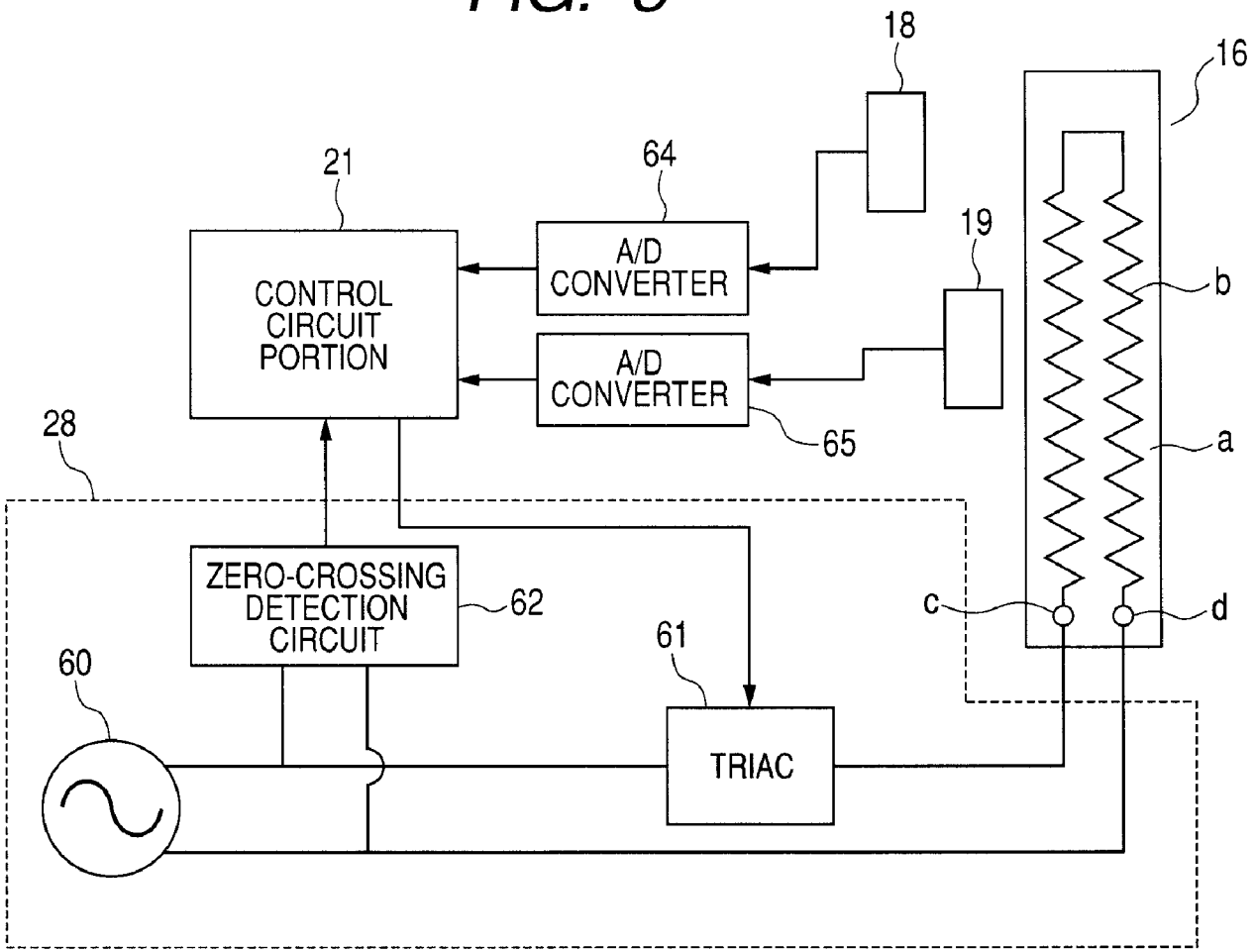
FIG. 5 is a block diagram illustrating a control circuit portion and a heater driving circuit portion of the heating device according to the present invention.

Outputs of the main thermistor 18 and the sub thermistor 19 are connected to a control circuit portion (CPU) 21 via A/D converters 64 and 65, respectively (FIG. 4 and FIG. 5). The control circuit portion 21 serves to determine the temperature control content of the heater 16 based on the outputs of the main thermistor 18 and the sub thermistor 19 and to control power supply to the heater 16 by means of a heater driving circuit portion 28 (FIG. 2 and FIG. 4) as a power supply portion (heating unit). In other words, the control circuit portion 21 functions as a power control portion. The power control portion controls power to be supplied from a commercial alternating current power source 60 to the heater 16 according to the detected temperature of the temperature detection element 18 (so that the detected temperature of the temperature detection element 18 is maintained at a target temperature).

In the exemplary embodiment, the main thermistor 18 detects the inner surface temperature of the heat film 20. Alternatively, as in the case of the sub thermistor 19, the main thermistor 18 can be disposed in the rear surface of the heater 16 to directly detect the temperature of the heater 16.

As illustrated in FIG. 2, an inlet guide 23 and discharge rollers 26 are assembled to the device frame 24. The inlet guide 23 serves to direct the transfer material so that the recording material P which has left the secondary transfer nip portion can correctly be guided to the heat nip portion H as an abutment portion between the heat film 20 and the pressure roller 22 at the heater 16. In this exemplary embodiment, the inlet guide 23 is made of polyphenylene sulfide (PPS) resin.

The pressure roller 22 is rotatingly driven by a driving unit (not shown) at a predetermined peripheral speed in a direction shown by the arrow. Upon the rotation of the pressure roller 22, by an abutment friction force between the outer surface of the pressure roller 22 and the heat film 20 at the heat nip portion H, a rotational force acts on the cylindrical heat film 20. Then, the heat film 20 is rotatingly driven around the heater holder 17 in a direction shown by the arrow while the inner surface of the heat film 20 is being closely contacted and slid on the lower surface of the heater 16. Grease is coated on the inner surface of the heat film 20 to ensure smooth sliding movement between the heater holder 17 and the inner surface of the heat film 20.

The pressure roller 22 is rotatingly driven to rotate the cylindrical heat film 20 accordingly, and the power is supplied to the heater 16 so that the start-up temperature control is performed to increase the temperature of the heater 16 to the predetermined temperature. In this state, the recording material P, bearing an unfixed toner image is introduced between the heat film 20 and the pressure roller 22 at the heat nip portion H along the inlet guide 23. Then, at the heat nip portion H, a surface of the recording material P, which bears the toner image, closely contacts the outer surface of the heat film 20 and is pinched and conveyed by the heat nip portion H together with the heat film 20. During such pinching and conveyance, heat from the heater 16 is applied to the recording material P through the heat film 20, and hence an unfixed toner image t formed on the recording material P is fused and fixed onto the recording material P by heat and pressure. The recording material P which has passed through the heat nip portion H is self-stripped from the heat film 20 by the curvature thereof and is discharged by the discharge rollers 26.

In the exemplary embodiment, the heat film 20 is a cylindrical (endless belt) member having an elastic layer formed thereon.

As a film material, for example, based on SUS, a silicone rubber layer (elastic layer) having a thickness of about 300 μm is formed on an endless belt formed into a cylindrical shape with a thickness of 30 μm by a ring coating method, and covered with a PFA resin tube (first surface layer) having a thickness of 30 μm. The inventors measured the heat capacity of the heat film 20 formed this way, and found that the heat capacity was $12.2\times10^{-2}$ J/cm$^2$·° C. (heat capacity per 1 cm$^2$ of the heat film).

For a base layer of the heat film 20, a resin such as polyimide can be used. However, a metal, such as SUS or nickel, is about ten times larger in heat conductivity than polyimide, and hence higher on-demand performance can be obtained. In the exemplary embodiment, a metal SUS is used for the base layer of the heat film 20.

For an elastic layer of the heat film 20, a rubber layer of a relatively high heat conductivity is used. This way, higher on-demand performance can be obtained. A material used in the exemplary embodiment has specific heat of about $12.2\times10^{-1}$ J/g·° C.

A fluorocarbon resin layer is formed on the surface of the heat film 20. Thus, the mold-releasing property of the surface can be improved, and the offset phenomenon, caused by temporary sticking of toner on the surface of the heat film 20 and re-movement of the toner to the recording material P, can be prevented. The fluorocarbon resin layer on the surface of the heat film 20 is set as a PFA tube, and hence a uniform fluorocarbon resin layer can be formed more easily.

Generally, when the heat capacity of the heat film 20 increases, the temperature increase slows down, and on-demand performance is lowered. For example, depending on the configuration of the heating device, if the device is started up within one minute without any stand-by temperature control, the heat capacity of the heat film 20 must be equal to or less than about 4.2 J/cm$^{2}$·° C.

In the exemplary embodiment, the device is designed such that in the case of starting up from a room temperature state, power of about 1000 W is supplied to the heater 16, and the temperature of the heat film 20 increases to 190° C. within twenty seconds. A material having specific heat of about $12.2\times10^{-1}$ J/g·° C. is used for the silicone rubber layer. The thickness of the silicone rubber layer must be equal to or less than 500 μm, and the heat capacity of the heat film 20 must be equal to or less than about $18.9\times10^{-2}$ J/cm$^{2}$·° C. Conversely, if the heat capacity is set equal to or less than $4.2\times10^{-2}$ J/cm$^{2}$·° C., the rubber layer of the heat film 20 becomes extremely thin, and the heating device suffers disadvantages similar to a heating device of a film-heating type device having no elastic layer in terms of image-quality, such as OHT transmittance and uneven glossiness.

In this exemplary embodiment, the thickness of the silicone rubber necessary for obtaining a high-quality image based on OHT transmittance and glossiness is 200 μm or higher. In this case, the heat capacity is $8.8\times10^{-2}$ J/cm$^{2}$·° C.

More specifically, in a configuration of a heating device similar to that of the exemplary embodiment, the target heat capacity of the heat film 20 is generally equal to or more than $4.2\times10^{-2}$ J/cm$^{2}$·° C. and equal to or less than 4.2 J/cm$^{2}$·° C. Among such heat films, a heat film having a heat capacity set to be equal to or more than $8.8\times10^{-2}$ J/cm$^{2}$·° C. and equal to or less than $18.9\times10^{-2}$ J/cm$^{2}$·° C. is used, which enables the achievement of both on-demand performance and high image quality.

As illustrated in FIGS. 2 and 3, the main thermistor 18 is disposed in the vicinity of the longitudinal center of the heat film 20 to contact the inner surface of the heat film 20. The main thermistor 18 is used as a unit for detecting the temperature of the heat film 20, which is the temperature nearer to the temperature of the heat nip portion. Thus, in a normal operation, temperature control is performed so that the detected temperature of the main thermistor 18 becomes the target temperature. As described above, the main thermistor 18 may be disposed in the rear surface of the heater 16. In such a case, the temperature of the rear surface of the heater is controlled to the target temperature.

As illustrated in FIG. 3, the sub thermistor 19 is disposed in the vicinity of the end of the heater 16 to contact the rear surface of the heater 16. The sub thermistor 19 serves to detect the temperature of the heater 16 as the heating element and acts as a safety device for monitoring so that the temperature of the heater does not exceed a predetermined temperature.

Further, overshoot of the temperature of the heater 16 in the start-up and end temperature increase are monitored by the sub thermistor 19. The monitoring results are used for determining whether to perform control to reduce through-put so that, for example, if the temperature of the end of the heater 16 exceeds a predetermined temperature due to the end temperature increase, the temperature of the end does not increase further.

In this exemplary embodiment, the heater 16 uses a ceramic heater in which conductive paste including an alloy of silver/palladium is coated on a substrate made of aluminum nitride by screen printing as a film having a uniform thickness to form a resistive heating element and a pressure resistant glass coat is provided on the film. FIG. 4 illustrates an example of a configuration of such a ceramic heater.

The heater 16 includes as a base material an elongated aluminum nitride substrate, a, having a longitudinal direction perpendicular to a sheet passing direction. The heater 16 also includes a resistive heating element layer, b, made of conductive paste including an alloy of silver/palladium (Ag/Pd) having a thickness of about 10 μm and a width of about 1 to 5 mm and coated on a front surface of the aluminum nitride substrate a along the longitudinal direction thereof by screen printing in a line shape or a strip shape, which layer generates heat when current flows through the layer. The heater 16 further includes a first electrode portion c, a second electrode portion d, and an extension electrical path portion e pattern-formed on the front surface of the aluminum nitride substrate a by screen printing using a silver paste, as power supply patterns for the resistive heating element layer b. The heater 16 further includes a thin glass coat g having a thickness of about 10 μm and capable of enduring sliding friction with respect to the heat film 20, which glass coat is formed on the resistive heating element layer b and the extension electrical path portion e in order to ensure protection and insulation of the resistive heating element layer and the extension electrical path portion, and the sub thermistor 19 provided on a rear surface of the aluminum nitride substrate a.

The heater 16 is fixedly supported by the heater holder 17 so that the front surface thereof is directed downwardly and is exposed.

A power supply connector 30 is connected to the first electrode portion c and the second electrode portion d of the heater 16. When power is supplied to the first electrode portion c and the second electrode portion d from the heater driving circuit portion 28 through the power supply connector 30, the resistive heating element layer b generates heat, to thereby increase the temperature of the heater 16 quickly. The heater driving circuit portion 28 is controlled by the control circuit portion (CPU) 21.

In normal usage, at the same time when the rotation of the pressure roller 22 is started, the driven rotation of the heat film 20 is started, and as the temperature of the heater 16 is increased, the temperature of the inner surface of the heat film 20 is increased. The supplying of the power to the heater 16 is controlled by PID control, and the applied power is controlled so that the temperature of the inner surface of the heat film 20, and thus, the detected temperature of the main thermistor 18 becomes 190° C.

FIG. 5 is a block diagram of the Control circuit portion (CPU) 21 as a power control portion of a fixing unit, and the heater driving circuit portion 28. The power supply electrode portions c and d of the heater 16 are connected to the heater driving circuit portion 28 through a power supply connector (not shown).

The heater driving circuit portion 28 includes the alternating current power source (commercial alternating current power source) 60, a triac 61, and a zero-crossing detection circuit 62. The triac 61 is controlled by the control circuit portion (CPU) 21. The triac 61 serves to perform power supply/power block with respect to the resistive heating element layer b of the heater 16.

The alternating current power source 60 sends a zero-crossing signal to the control circuit portion 21 through the zero-crossing detection circuit 62. The control circuit portion 21 controls the triac 61 based on the zero-cross signal. By supplying the power from the heater driving circuit portion 28 to the resistive heating element layer b of the heater 16 in this way, the temperature of the entire heater 16 is increased quickly.

Outputs of the main thermistor 18 for detecting the temperature of the heat film 20 and the sub thermistor for detecting the temperature of the heater 16 are received by the control circuit portion (CPU) 21 through the A/D converters 64 and 65, respectively.

The control circuit portion 21 controls the power supplied to the heater 16 by PID control by means of the triac 61 based on temperature information of the heat film from the main thermistor 18, to thereby control the temperature of the heat film 20 to be maintained at a predetermined control target temperature (set temperature).

The PID control is control for determining a control value by combining proportion control (hereinafter, referred to as "P control"), integral control (hereinafter, referred to as "I control"), and differential control (hereinafter, referred to as "D control") according to an output value from a control target.

As a method for controlling the supply of power, in the exemplary embodiment, wave number control (ON/OFF control) is used as normal main control. The wave number control is switched to phase control prior to the time for correcting the supply of power (supplying predetermined power to the heater) before the entry of the recording material P, and power correction is performed by the phase control. Then, at the time when the power correction is finished, the phase control is switched to the wave number control again. A wave number control mode is set as a first power supply control mode, and a phase control mode is set as a second power supply control mode. A mode for supplying the predetermined power to the heater is set as a third power supply control mode. In the first power supply control mode, with a predetermined number of half waves more than two continuous waves in an alternating current waveform set as one control cycle, power is supplied to the heater according to a detected temperature of the temperature detection element for each control cycle. In the second power control mode, with a predetermined number of half waves equal in number to or less than the two continuous waves in the alternating current waveform set as one control cycle, power is supplied to the heater according to the detected temperature of the temperature detection element for each control cycle. In the third power supply control mode, predetermined power is supplied to the heater irrespective of the detected temperature of the temperature detection element. The power control portion can set the first power supply control mode, the second power supply control mode, or the third power supply control mode.

The switching of the wave number control to the phase control prior to the timing of the power correction enables starting of the power correction by the phase control where a revising cycle (one control cycle) of the power supply ratio is short. As a result, the timing shift of the power correction is minimized, and uneven brightness caused by a power shortage due to the timing shift and hot offset caused by overshooting of the target temperature can be reduced.

The use of the phase control is limited to a very short period of power correction performed in association with the entry of the recording material into the heat nip, and most of supply power control is performed based on the wave number control. Thus, an increase in harmonic current can be minimized.

In the exemplary embodiment, the PID control is stopped 100 milliseconds before the entry of the recording material P into the heat nip portion H, and power correction for supplying predetermined power is performed from this time until passage of 0 milliseconds after the entry of the recording material. The switching from the wave number control to the phase control is performed from 300 milliseconds before the entry of the recording material P into the heat nip portion H until the passage of 0 milliseconds after the entry of the recording material.

A period of supplying a predetermined amount of power without performing any PID control and power are selected so that uneven heating (step of glossiness) generated between a trailing edge of first rotation and a leading edge of second rotation of the heat film can be minimized during heating of the recording material by the heat film 20. The power correction is started before the entry of the recording material P at the time of starting sheet feeding in view of a period of time from actual supplying of correction power to an increase in temperature of the heater 16. More specifically, the heater temperature does not completely follow steep supplying of power, and hence a slight time lag is generated until the power supply is actually reflected in the temperature. Needless to say, there is contact thermal resistance from the heater 16 to the inner surface of the heat film, and hence heat is not immediately conducted. Thus, when heat is appropriately supplied to a portion of the heat film 20 corresponding to the leading edge of the recording material leading edge, supplying power after the entry of the of the recording material P into the heat nip portion H is too late.

The timing of starting the power correction in sequence is determined in view of such a time lag. In the exemplary embodiment, start timing is 100 milliseconds before the recording material P enters the heat nip portion H.

This timing is set with a slight margin with respect to the entry timing of the recording material P into the heat nip portion H in this exemplary embodiment. More specifically, ideally, timing at which heat generation of the heater is reflected in the temperature of the inner surface of the heat film can completely match the entry timing of the recording material. However, the power correction is started at timing slightly earlier. This is because selection, when variance on heat conduction is considered, of complete matching of the power correction with the entry timing of the recording material is difficult, and hence rather than delaying power correction, which lowers the temperature, power correction is started slightly earlier to adjust the temperature to be higher slightly. This exemplary embodiment poses no practical problem. Needless to say, however, when this margin is larger even to a slight extent, the hot-offset risk is higher. This setting is not limited to the configuration of this present exemplary embodiment, but various selections can be appropriately made.

The power correction start (predetermined power supply start) timing is set based on the entry timing of the recording material P into the heat nip portion H. In actuality, in this exemplary embodiment, the power correction start timing is based on conveying start timing of the recording material P by the registration rollers 46. More specifically, at the time of starting conveying of the recording material P by the registration rollers 46, the leading edge of the recording material P is at a position of the registration sensor 47. Thus, entry timing of the recording material P into the heat nip portion H from the position is predicted, and the entry timing is determined based on the prediction. In other words, an actual control reference point is a conveying start of the recording material P by the registration rollers 46. In this exemplary embodiment, the registration roller 46 is a reference point. However, a sensor for detecting a conveying state may be separately disposed on the upstream side of the heating device, and a result of the detection may be set as a reference point.

In this exemplary embodiment, when power to be supplied to the heater 16 is corrected, consideration is given to a difference in heat capacity of different recording materials, which depends on their basis weight. More specifically, power used for correction is changed according to the basis weight of the recording material P. In this exemplary embodiment, power to be supplied to the heater 16 is corrected according to a table of cases for respective paper modes from a necessary power value obtained by experiment. In actuality, the user designates a print mode. The host computer (not shown) receives print mode information together with a print signal, and the control circuit portion 21 determines supply power during sheet feeding.

The paper modes and the supply power during correction in this exemplary embodiment is shown in the following Table 1.

TABLE 1

| Basis weight ($g/m^2$) | Paper mode | Supply power during correction |
|---|---|---|
| 60~70 | Thin paper | 50 W |
| 71~90 | Normal | 100 W |
| 91~128 | Thick paper 1 | 250 W |
| 129~220 | Thick paper 2 | 350 W |

Figure 6:
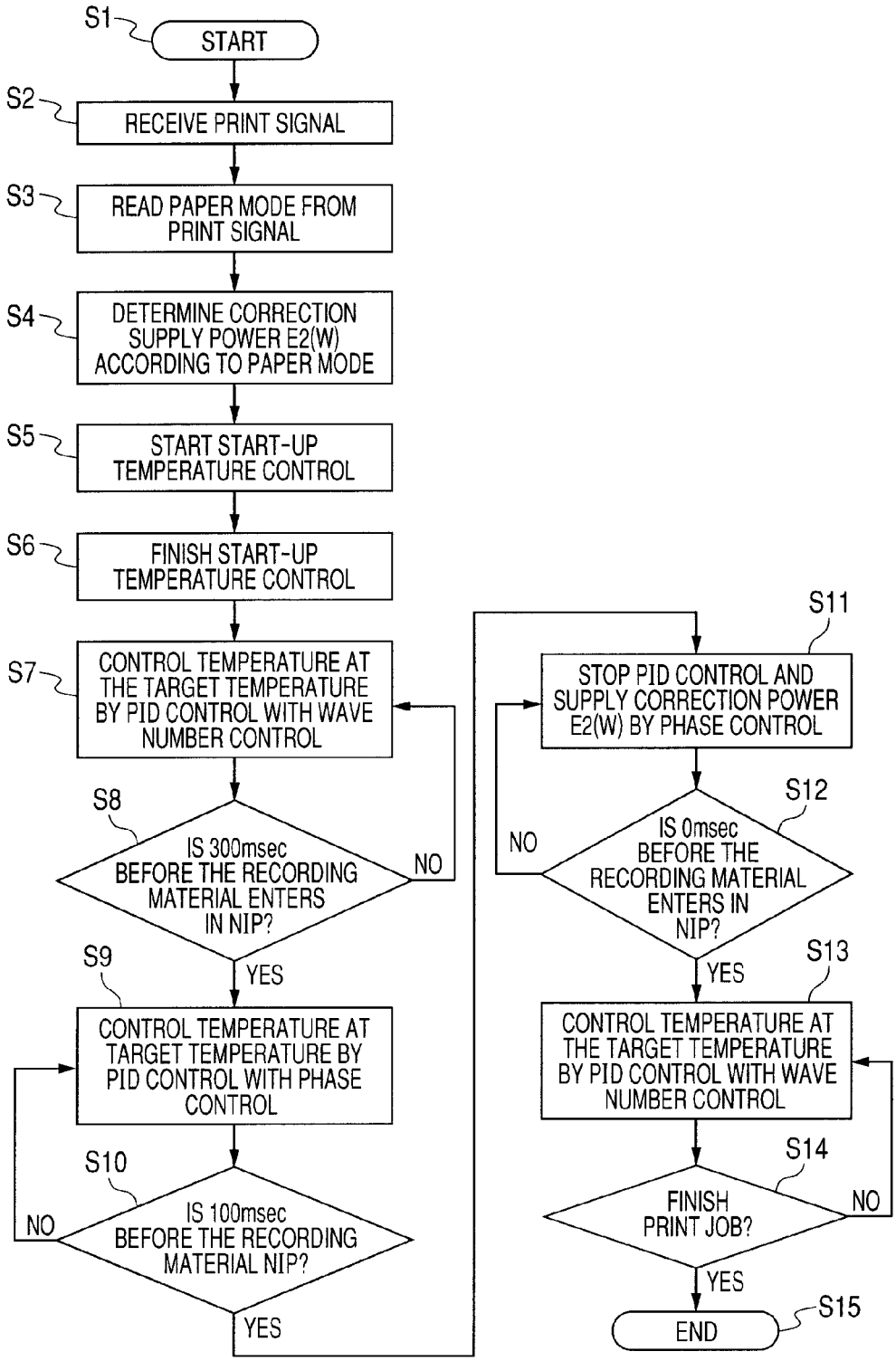
FIG. 6 is a flowchart illustrating power correction to be carried out in the first exemplary embodiment.

FIG. 6 is a flowchart illustrating a power control method according to this exemplary embodiment.

An actual correction operation is described based on the flowchart.

In this exemplary embodiment, a case where a frequency of alternating current power (AC power) is 50 Hz is described.

In FIG. 6, in Step S1, the image forming apparatus is started in a state in which a print signal is receivable after power is turned ON. In Step S2, a print signal is received from the host computer (not shown). In Step S3, a paper mode is read from the print signal. In Step S4, the control circuit portion (CPU) 21 in the printer determines correction supply power E2 (W) according to the paper mode as shown in Table 1. Then, in Step S5, the control circuit portion 21 drives the heater driving circuit portion 28, and starts start-up temperature control of the heater 16 in order to control the heat film 20 to have a predetermined temperature. In this case, control of power supply to the heater 16 is performed based on wave number control. In this exemplary embodiment, in the wave number control, a power supply ratio is revised with 20 half waves (predetermined number of waves) set as one unit. More specifically, the power supply ratios are controlled at every 5% from 0 half waves (0% power supply) to 20 half waves (100% power supply), and a revising cycle of the power supply ratio is 200 milliseconds when the AC power is 50 Hz.

In Step S6, the temperature of the heat film 20 is controlled near the predetermined temperature, and the start-up temperature control is finished. In Step S7, 190° C., which is a temperature for print temperature control, is set as a target temperature, and the temperature is controlled to the target temperature by PID control. In this case, supply power control is based on the wave number control.

Then, 300 milliseconds before the entry of the recording material, in Step S8, the supply power control is switched from the wave number control to phase control. In the phase control, in order to control heating in 5% increments in association with the power supply ratios during the wave number control, a power supply angle, each controlled at 5% increments is used with respect to one half wave of an alternating current waveform supplied from a power source. The power supply angle is obtained as timing of turning the triac 61 ON by using time when the zero-crossing detection circuit detects a zero-crossing signal as a starting point. Only during the phase control, the power supply ratio can be set more minutely.

In this case, even when the control circuit portion 21 issues a switch command, the wave number control cannot be immediately switched to the phase control unless a revising cycle of the power supply cycle of the wave number control matches this timing. Thus, in actuality, the wave number control is switched to the phase control after the revised timing of the power supply ratio of the wave number control arrives.

In Step S9, the processing stands by at a target temperature while performing the PID control by using the phase control as power control until 100 milliseconds before the entry of the recording material.

100 milliseconds before the entry of the recording material, in Step S10, the PID control is stopped, and the predetermined power E2 (W) determined as the correction supply power in Step S4 is output. In Step S11, the power E2 (W) continues to be supplied until 0 milliseconds after the entry of the recording material. In this case, the power control is phase control, and the predetermined power is defined based on the power supply angle (phase angle) within one half wave of an alternating current waveform.

In Steps S12 and S13, with a passage of 0 milliseconds after the entry of the recording material, the phase control is switched to the wave number control for updating the power supply ratio with original 20 half waves set as one unit. Simultaneously, 190° C., which is a temperature for print temperature control, is set as a target temperature to resume the PID control.

In Step S14, the above-mentioned operation continues until the printing is finished. In Step S15, when the print job is finished, the temperature control is finished. This correction is performed based on Table 1 of the paper mode and the correction supply power E2 (W) provided in the control circuit portion (CPU) 21 of the printer.

Thus, the power control portion switches, immediately before the leading edge of the recording sheet enters the fixing portion, the state of supplying power in the first power supply control mode to the state of supplying power in the second power supply control mode, switches the state of supplying power in the second power supply control mode to the state of supplying power in the third power supply control mode, and switches the state of supplying power in the third power supply control mode to the state of supplying power in the first power supply control mode.

The fixing portion fixes the unfixed toner image onto the recording material in a state in which power is supplied to the heater in the first power supply control mode.

A reason for switching to the phase control 300 milliseconds before the entry of the recording material into the heat nip is described below.

Figure 7:
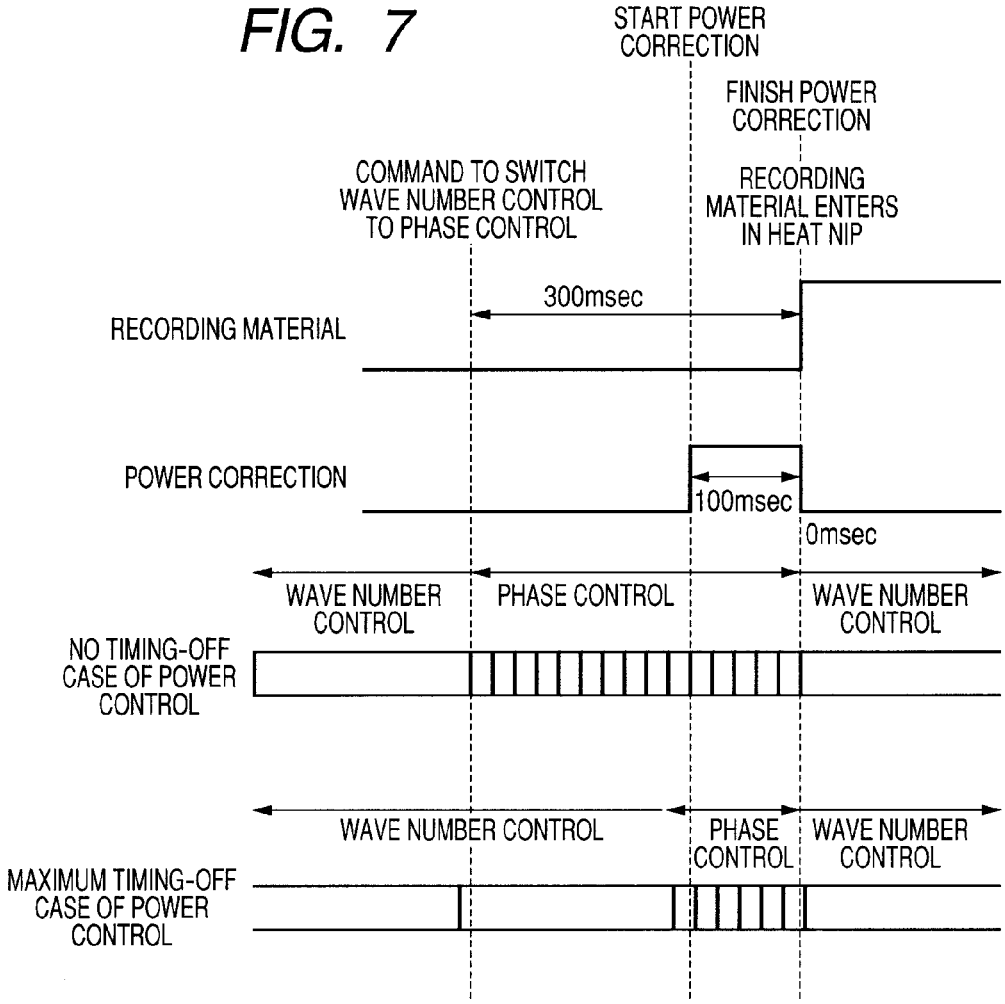
FIG. 7 is a timing chart of supply power according to the first exemplary embodiment.

FIG. 7 is a timing chart illustrating the supply of power.

In the exemplary embodiment, the power correction is started 100 milliseconds before the entry of the recording material into the heat nip. However, unless the revising cycle of the power supply ratio matches this timing, the power correction is not appropriately performed, causing uneven brightness or hot offset. If the wave number control continues until this timing, unless the revised timing of the power supply ratio matches the timing of the power correction by accident, the wave number control cannot be switched to the phase control even when the phase control is used at the timing of the power correction. Obviously, therefore, switching from the wave number control to the phase control must be performed before the timing of the power correction. Assuming that the revised timing of the power supply ratio of the wave number control does not match the timing of switching from the wave number control to the phase control, even if the timing shifts at the maximum, setting must be performed to assure switching to the phase control before the power correction timing. During a period of time corresponding to the revising cycle of the power supply ratio of the wave number control, the wave number control cannot be switched to the phase control. Thus, in order to assure switching to the phase control before the power correction timing, the wave number control is switched to the phase control at timing earlier by the period of time corresponding to the revising cycle of the wave number control or longer than the power correction timing. The exemplary embodiment uses the wave number control for updating the power supply ratio with a predetermined number of half waves equal in number to or more than the two continuous half waves, i.e., 20 half waves, being set as one unit, and the revising cycle of supply power is 200 milliseconds. Hence, the wave number control only needs to be switched to the phase control 200 milliseconds before the start of the power correction. In other words, the timing of the power correction is 100 milliseconds before the entry of the recording material, and hence switching to the phase control is performed 300 milliseconds before.

Needless to say, this timing is a minimum value to minimize an increase in harmonic current. In view of preventing a timing shift of the power correction, any timing at least 200 milliseconds before the start of power correction may be chosen.

In the exemplary embodiment, the timing of switching from the phase control back to the wave number control matches the stop of the power correction. Alternatively, in view of preventing a timing shift of the power correction, any timing after the stop of the power correction may be chosen.

The exemplary embodiment has been described by way of a case where the alternating current power is 50 Hz. In the case of 60 Hz, time per wave of an AC voltage is different, and hence timing of switching from the wave number control to the phase control may naturally be different. In the case of 60 Hz, one half wave is about 8.33 milliseconds. Thus, in the exemplary embodiment where the revising cycle of the power supply ratio is 20 half waves, timewise, the wave number control may be switched to the phase control about 166.6 milliseconds before the start of the power correction. When the entry of the recording material into the heat nip is a reference point, switching is performed at least 266.6 milliseconds before the start of the power correction.

The frequency of alternating current power may be detected, and a set value may be varied depending on the frequency. Switch timing is earlier in 50 Hz than in 60 Hz. Thus, according to a conceivably lowest power frequency, switch timing can be set to the earliest timing irrespective of the power frequency.

This value is adopted because the revising cycle of the wave number control of the exemplary embodiment is 20 half waves, and the value is in no way limiting. For example, in the case of wave number control for updating a power supply ratio every 10 half waves, the revising cycle is 10 milliseconds, and hence the wave number control may be switched to phase control 100 milliseconds before the start of power correction.

In the above-mentioned example, when the power to be supplied to the heater 16 is corrected, the difference in heat capacity based on the basis weight of the recording material P is taken into consideration as the paper mode. However, as a paper mode, an operation speed of the apparatus may be varied. More specifically, the apparatus may be operated by varying a fixing temperature at a normal speed between recording materials of basis weights of 60 to 70 g/m$^2$ and 71 to 90 g/m$^2$ set as the thin-paper mode and the normal mode. The apparatus may be operated at a speed ½ the normal speed in the case of a recording material of a basis weight of 91 to 128 g/m$^2$ set as the thick-paper mode 1. The apparatus may be operated at a speed ⅓ the normal speed in the case of a recording material of a basis weight of 129 to 220 g/m$^2$ set as the thick-paper mode 2. In such a case, not only the correction power, but also the correction timing may be varied.

As this method, for example, as shown in Table 2, a table of correction power and correction timing may be used according to the paper mode, and parameters of power correction may be set when a paper mode is determined based on a print signal.

TABLE 2

| Basis weight (g/m$^2$) | Paper mode | Operation speed | Correction supply power | Correction start timing recording material entry reference point | Correction stop timing recording material entry reference point |
|---|---|---|---|---|---|
| 60~70 | Thin paper | 1/1 speed | 50 W | 100 milliseconds before | 0 milliseconds after |
| 71~90 | Normal | 1/1 speed | 100 W | 100 milliseconds before | 0 milliseconds after |
| 91~128 | Thick paper 1 | 1/2 speed | 250 W | 110 milliseconds before | 10 milliseconds after |
| 129~220 | Thick paper 2 | 1/3 speed | 350 W | 120 milliseconds before | 20 milliseconds after |

A reason for varying the correction timing from one operation speed to another is that in this exemplary embodiment, as described above, the power correction start timing has a slight margin with respect to the entry timing of the recording material P into the heat nip portion H. As the operation speed of the apparatus decreases, the rotational speed of the heat film decreases. In this case, if periods of time taken as margins are equal, an area corresponding to the margin is narrower in terms of the traveling distance of the heat film by an amount corresponding to the reduced rotational speed. Thus, when the operation speed of the apparatus is low, a small amount equivalent to the margin may be added. Needless to say, this case applies when the margin is taken into consideration. It is not always necessary to vary the correction timing from one operation speed to another, nor is the description of this exemplary embodiment limited to this. For example, if the power correction timing is set to completely match entry of the recording material into the nip, the correction start timing is set to correspond to the time lag of heat transmission from the heater to the heat film inner surface, and the correction start timing does not need to be changed according to the operation speed.

When the correction timing is different, naturally, switch timing from the wave number control to the phase control is different. In the case of Table 2, in the exemplary embodiment, switch timing to the phase control is 310 milliseconds before the entry of the recording material if correction start timing is 110 milliseconds before, and 320 milliseconds before the entry of the recording material if correction start timing is 120 milliseconds.

As described above, the reason is that the wave number control must be switched to the phase control earlier by a period of time corresponding to the revising cycle of the wave number control or more than the correction start timing. In the exemplary embodiment, the revising cycle of the wave number control is 200 milliseconds, and hence the wave number control is switched to the phase control 200 milliseconds before each correction start timing.

the basis weight is set as the paper mode. Alternatively, a difference based on a surface property of the recording material P may be included in the paper mode. In the cases of a recording material called rough paper, due to low smoothness of the recording material surface, glossy paper having an extremely smooth surface, and a film recording material such as OHT, heat transmission from the heating device to the recording material P and heat capacity are different from those of a general print sheet, and hence the power used for power correction is different. Thus, optimal control can be performed by varying the power correction value according to a type of a recording material.

Table 3 shows each paper mode including a type of a recording material and power correction parameters. For glossy paper, in order to achieve a high glossiness, even if the basis weight is low, the operation speed of the apparatus is lowered to increase the amount of heating per unit time. Rough paper has a rough surface and a poor fixing property, and hence the operation speed of the apparatus is similarly lowered to increase the amount of heating per unit time, thereby assuring fixing.

TABLE 3

| Basis weight ($g/m^2$) | Paper mode | | Operation speed | Correction supply power | Correction start timing recording material entry reference point | Correction stop timing recording material entry reference point |
|---|---|---|---|---|---|---|
| 60~70 | Thin paper | Plain paper | 1/1 speed | 50 W | 100 milliseconds before | 0 milliseconds after |
| | | Rough paper | 1/2 speed | 30 W | 110 milliseconds before | 0 milliseconds after |
| | | Glossy paper | 1/2 speed | 150 W | 110 milliseconds before | 0 milliseconds after |
| 71~90 | Normal | Plain paper | 1/1 speed | 100 W | 100 milliseconds before | 0 milliseconds after |
| | | Rough paper | 1/2 speed | 50 W | 110 milliseconds before | 0 milliseconds after |
| | | Glossy paper | 1/2 speed | 200 W | 110 milliseconds before | 10 milliseconds after |
| 91~128 | Thick paper 1 | Plain paper | 1/2 speed | 250 W | 110 milliseconds before | 10 milliseconds after |
| | | Rough paper | 1/3 speed | 75 W | 120 milliseconds before | 10 milliseconds after |
| | | Glossy paper | 1/3 speed | 400 W | 120 milliseconds before | 20 milliseconds after |
| 129~220 | Thick paper 2 | Plain paper | 1/2 speed | 350 W | 110 milliseconds before | 10 milliseconds after |
| | | Rough paper | 1/3 speed | 125 W | 120 milliseconds before | 20 milliseconds after |
| | | Glossy paper | 1/4 speed | 400 W | 130 milliseconds before | 30 milliseconds after |
| — | OHT | 1/4 speed | 1/4 speed | 300 W | 130 milliseconds before | 30 milliseconds after |

Concerning the correction stop timing, a larger amount of heat is removed from the nip for thick paper during the entry of the recording material, and hence the period of time until the surface temperature of the heat film is stabilized is slightly longer than thin paper. Thus, in the exemplary embodiment, there is more of a delay in the correction stop timing in the case of the use of a larger basis weight recording material in order to achieve matching. Depending on the device configuration regarding the heat capacity or the heat transmittance of the heat film or the heater, however, correction stop timing does not always need to be varied from one basis weight to another.

The switch timing from the phase control to the wave number control matches the correction stop timing. As described above, however, any timing after the correction stop timing is adopted. In the above-mentioned example, only The user can designate the type of a recording material P based on the paper mode set by a printer driver or a control panel. Alternatively, the type of a recording material P may be determined by the media sensor 51.

Figure 8:
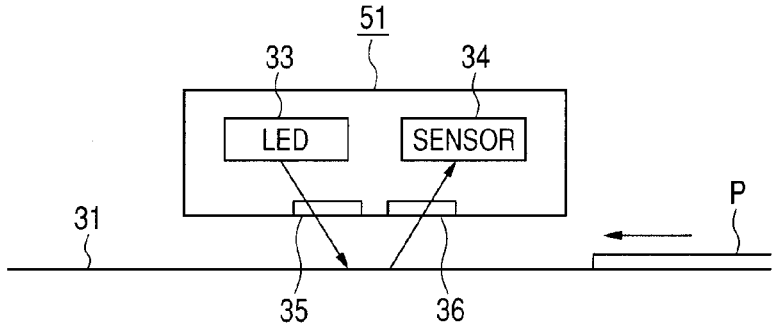
FIG. 8 schematically illustrates a configuration of a media sensor.

As illustrated in FIG. 1, the image forming apparatus of the exemplary embodiment includes the media sensor 51. FIG. 8 schematically illustrates a configuration of the media sensor 51. The media sensor 51 includes an LED 33 as a light source, a CMOS sensor 34 as a reading unit, and lenses 35 and 36 as image forming lenses. Light from the LED 33 as the light source is projected onto a recording material conveying guide 31 or the surface of the recording material P on the recording material conveying guide 31 through the lens 35. Reflected light is condensed by the lens 36 and is focused on the CMOS sensor 34. In this way, an image of the surface of the recording material conveying guide 31 or the recording material P is read. Thus, the surface condition of paper fibers of the recording material P is read and an analog output therefrom is A/D-converted to obtain digital data. A gain calculation and a filter calculation of the digital data are processed by a control processor (not shown) in a programmable manner. Then, an image comparison operation is performed and the paper type is determined based on the image comparison operation result.

control without using phase control, the correction timing shift is at a permissible level.

Thus, for example, a configuration can be employed where no switching is executed from wave number control to phase control depending on the basis weight or the type of recording material. In this case, when power correction parameters are set according to a paper mode, for example, Table 4 may be used.

TABLE 4

| Basis weight ($g/m^2$) | Paper mode | Operation speed | | Correction supply power | Correction start timing recording material entry reference point | Correction stop timing recording material entry reference point | Switching from wave number control to phase control |
|---|---|---|---|---|---|---|---|
| 60~70 | Thin paper | Plain paper | 1/1 speed | 50 W | 100 milliseconds before | 0 milliseconds after | No |
| | | Rough paper | 1/2 speed | 30 W | 110 milliseconds before | 0 milliseconds after | No |
| | | Glossy paper | 1/2 speed | 150 W | 110 milliseconds before | 0 milliseconds after | Yes |
| 71~90 | Normal | Plain paper | 1/1 speed | 100 W | 100 milliseconds before | 0 milliseconds after | No |
| | | Rough paper | 1/2 speed | 50 W | 110 milliseconds before | 0 milliseconds after | No |
| | | Glossy paper | 1/2 speed | 200 W | 110 milliseconds before | 10 milliseconds after | Yes |
| 91~128 | Thick paper 1 | Plain paper | 1/2 speed | 250 W | 110 milliseconds before | 10 milliseconds after | No |
| | | Rough paper | 1/3 speed | 75 W | 120 milliseconds before | 10 milliseconds after | No |
| | | Glossy paper | 1/3 speed | 400 W | 120 milliseconds before | 20 milliseconds after | Yes |
| 129~220 | Thick paper 2 | Plain paper | 1/2 speed | 350 W | 110 milliseconds before | 10 milliseconds after | Yes |
| | | Rough paper | 1/3 speed | 125 W | 120 milliseconds before | 20 milliseconds after | No |
| | | Glossy paper | 1/4 speed | 400 W | 130 milliseconds before | 30 milliseconds after | Yes |
| — | OHT | 1/4 speed | 1/4 speed | 300 W | 130 milliseconds before | 30 milliseconds after | Yes |

It is with glossy paper that a step is easily generated especially by uneven brightness due to the entry of the recording material P into the heat nip portion H. Glossy paper has extremely high surface smoothness, and hence even a minute temperature difference appears as a difference of glossiness. In glossy paper having a smooth surface, a minute temperature difference appears as a hot offset, and hence high accuracy is required for a power correction value and correction timing. In the case of a recording material of a large basis weight, the influence of the basis weight on the reduction in image quality appears relatively easily because of a great temperature change caused by the entry of the recording material P into the heat nip portion H. Thus, in Table 3, power correction values are large in the case of the glossy paper and the thick paper.

Conversely, in the case of a generally used print sheet having a basis weight of 64 to 90 $g/m^2$, surface smoothness is not so high. Because of the small basis weight, a temperature change of the heat film caused by the entry of the recording material P into the heat nip portion H is small.

Thus, in a normal print sheet having a small basis weight, the power correction value is small, and the correction timing is not so strict. In the case of rough paper, its surface is not smooth, and hence its surface is difficult to make glossy. In the print sheet of this type, a glossiness step is not so conspicuous even if no correction is performed. As a result, even when power correction is performed only based on wave number Concerning the power correction timing of the exemplary embodiment, the above-mentioned numerical values are in no way limiting. In the exemplary embodiment, power correction is performed before and after the entry of the recording material into the heat nip. However, power correction may be completed before the entry of the recording material. This is obvious because the power correction period is set on the assumption that a time lag is generated in the temperature increase of the heater with respect to the supply of power to the heater.

As described above, the PID control is stopped for a fixed period of time before/after the entry timing of the recording material P into the heat nip portion H, and the power supplied to the heater 16 is corrected to a predetermined value to be supplied. In this case, by switching the wave number control to phase control before the power correction timing, the shift between the power correction timing and the revised timing of the supply power can be reduced as much as possible without increasing the harmonic current. As a result, more stable temperature control can be performed without generating any temperature fluctuation accompanying the entry of the recording material P.

Second Exemplary Embodiment

In the first exemplary embodiment, wave number control is mainly used for controlling the power supply ratio when the power is supplied. In the exemplary embodiment, control combining wave number control and phase control is used. In this case, the power supply ratio in a predetermined cycle is controlled by always including a waveform for supplying power 100% or supplying no power (0% power supply) with respect to one half wave within a predetermined cycle as in the case of the wave number control, and including a waveform for controlling a power supply angle with respect to one half wave within the same cycle, to perform phase control. This control is defined as "hybrid control".

More specifically, the hybrid control is basically wave number control with several waves of one half wave or more set as one unit, but phase control is performed with respect to some half waves thereof.

In this hybrid control, a control cycle includes a waveform for performing phase control, and hence the power supply ratio can be minutely set, and the control cycle can be shortened more than when a power supply ratio is controlled only based on wave number control. Phase control is performed for only a partial wave of an AC voltage, and hence an increase of a harmonic current can be suppressed more strongly than when the power supply ratio is controlled only based on phase control.

In the exemplary embodiment, the control cycle of the power supply ratio is 8 half waves. In the case of an alternating current power of 50 Hz, a control cycle (revising cycle) is 80 milliseconds.

When normal wave number control is performed by 8 half waves, the power supply ratios can only be controlled at every 12.5%, and hence the fluctuation width of power supplied to a heater is larger. Temperature ripples of the heater become larger. Thus, when a visible image is heated, uneven heating easily appears as uneven brightness on the image. On the other hand, in the hybrid control of the exemplary embodiment, 8 half waves include some half waves for performing phase control, enabling minute setting of the power supply ratio even by 8 half waves.

The revising cycle of the power supply ratio during a normal operation can be shortened more than when only the wave number control by 20 half waves is used. Thus, control can be more stable with no unevenness, and flicker noise can be reduced.

In hybrid control, the number of waves per unit can be reduced. However, if the number of waves per unit is reduced excessively, the ratio of phase control with respect to overall control is higher, causing an increase of the harmonic current. Thus, in the exemplary embodiment, the number of half waves balances these competing considerations, i.e., 8 half waves are set as the revising cycle of the power supply ratio. Needless to say, the setting varies depending on apparatus configurations, and this setting is in no way limiting.

In actual control, a waveform pattern of AC voltage is set in advance for each power supply ratio, and power is supplied according to the waveform pattern for each power supply ratio set by the PID control.

Table 5 shows a waveform pattern for each power supply ratio in the exemplary embodiment. In this exemplary embodiment, total of 21 waveform patterns are set from 0% to 100% while the power supply ratios are set in increments of 5%. In the exemplary embodiment as well as the first exemplary embodiment, the example of the power supply ratios set in increments of 5% is described. Needless to say, however, power supply ratios may be set more minutely, for example, in increments of 1%. In the hybrid control, the half waves for performing phase control are included, and hence a control unit of the number of waves does not need to be increased even if the power supply ratios are set minutely.

TABLE 5

| | 8 half waves constitute 1 control cycle | | | | | | | |
|---|---|---|---|---|---|---|---|---|
| Total power supply ratio | 1st half wave | 2nd half wave | 3rd half wave | 4th half wave | 5th half wave | 6th half wave | 7th half wave | 8th half wave |
| 0% | 0% | 0% | 0% | 0% | 0% | 0% | 0% | 0% |
| 5% | 0% | 0% | 20% | 0% | 0% | 20% | 0% | 0% |
| 10% | 0% | 0% | 40% | 0% | 0% | 40% | 0% | 0% |
| 15 | 0% | 0% | 60% | 0% | 0% | 60% | 0% | 0% |
| 20% | 0% | 0% | 80% | 0% | 0% | 80% | 0% | 0% |
| 25% | 0% | 0% | 100% | 0% | 0% | 100% | 0% | 0% |
| 30% | 20% | 0% | 0% | 100% | 100% | 0% | 0% | 20% |
| 35% | 40% | 0% | 0% | 100% | 100% | 0% | 0% | 40% |
| 40% | 0% | 100% | 0% | 60% | 60% | 0% | 100% | 0% |
| 45% | 0% | 100% | 0% | 80% | 80% | 0% | 100% | 0% |
| 50% | 0% | 100% | 0% | 100% | 100% | 0% | 100% | 0% |
| 55% | 0% | 100% | 100% | 0% | 66% | 54% | 54% | 66% |
| 60% | 100% | 40% | 40% | 100% | 0% | 100% | 100% | 0% |
| 65% | 100% | 60% | 60% | 100% | 0% | 100% | 100% | 0% |
| 70% | 100% | 80% | 80% | 100% | 0% | 100% | 100% | 0% |
| 75% | 100% | 100% | 100% | 100% | 0% | 100% | 100% | 0% |
| 80% | 100% | 100% | 54% | 54% | 100% | 100% | 66% | 66% |
| 85% | 100% | 100% | 64% | 64% | 100% | 100% | 76% | 76% |
| 90% | 100% | 100% | 60% | 60% | 100% | 100% | 100% | 100% |
| 95% | 100% | 100% | 80% | 80% | 100% | 100% | 100% | 100% |
| 100% | 100% | 100% | 100% | 100% | 100% | 100% | 100% | 100% |

In the exemplary embodiment, supply power control is performed based on hybrid control using the above-mentioned waveform patterns. Hybrid control is switched to phase control prior to the time of correcting the power supplied to the heater before the entry time of a recording material into a heat nip, and the power correction is performed based on the phase control.

More specifically, in the exemplary embodiment, as in the first exemplary embodiment, a power control portion switches, immediately before a leading edge of a recording sheet enters a fixing portion, a state of supplying power in a first power supply control mode to a state of supplying power in a second power supply control mode, then switches the state of supplying power in the second power supply control mode to a state of supplying power in a third power supply control mode, and then switches the state of supplying power in the third power supply control mode to the state of supplying power in the first power supply control mode. The fixing portion fixes an unfixed toner image onto the recording material under a state where power is supplied to the heater in the first power supply control mode.

Figure 9:
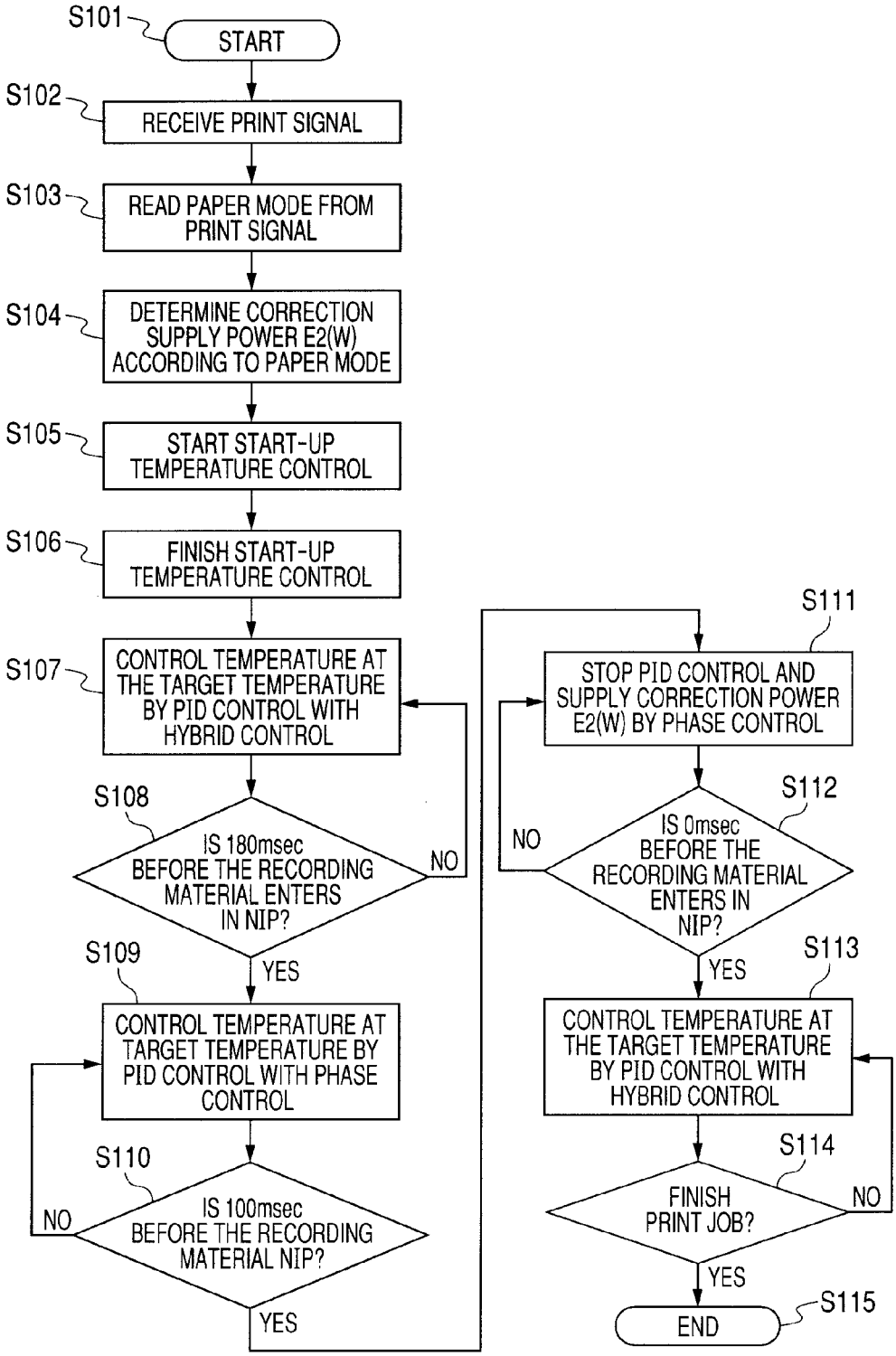
FIG. 9 is a flowchart illustrating power correction to be carried out in the second exemplary embodiment.
Figure 10:
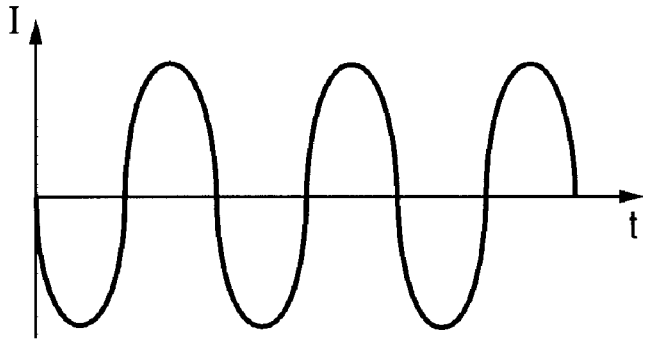
FIG. 10 illustrates a waveform of input alternating current power.
Figure 11:
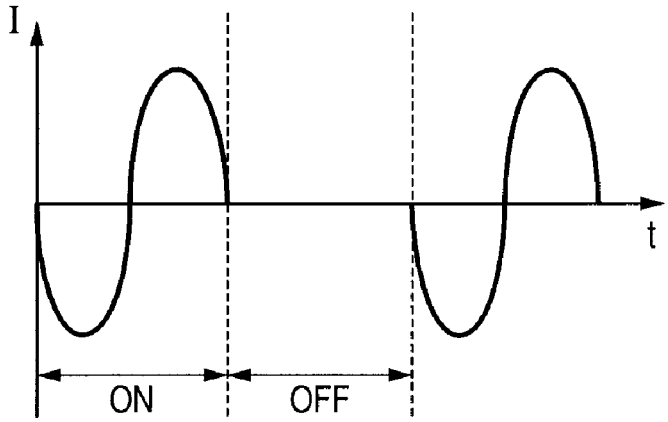
FIG. 11 illustrates a power supply waveform in wave number control.
Figure 12:
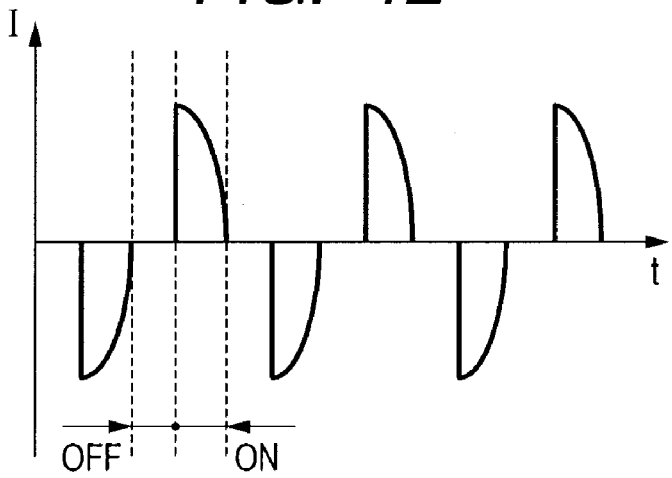
FIG. 12 illustrates a power supply waveform in phase control.
Figure 13:
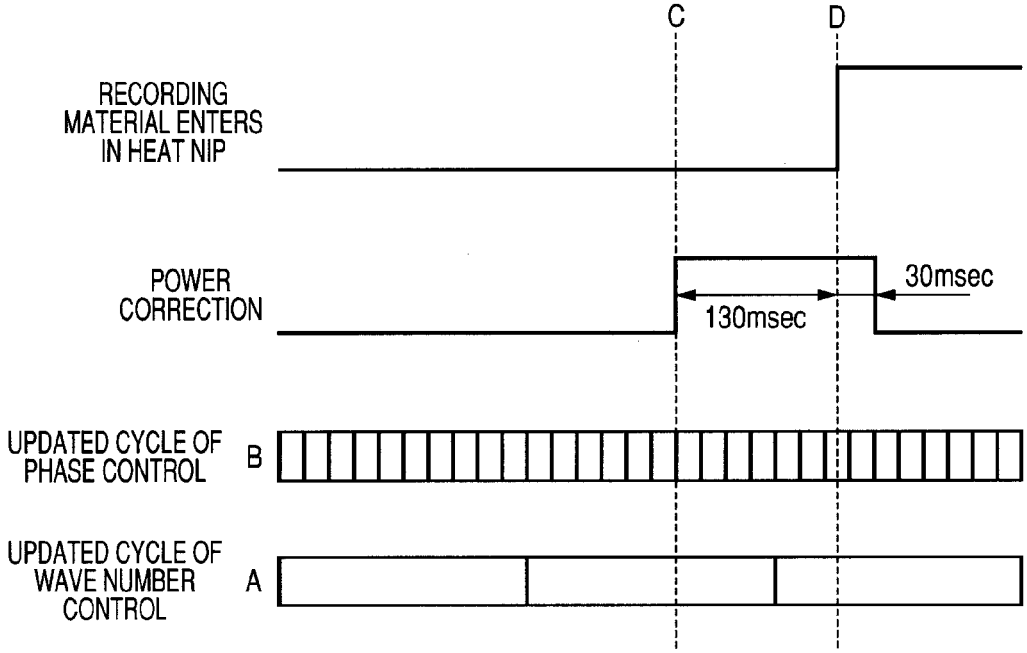
FIG. 13 is a timing chart illustrating revising cycles of power supply ratios of the wave number control and the phase control, and timing of recording material entry and the power correction.
Figure 14:
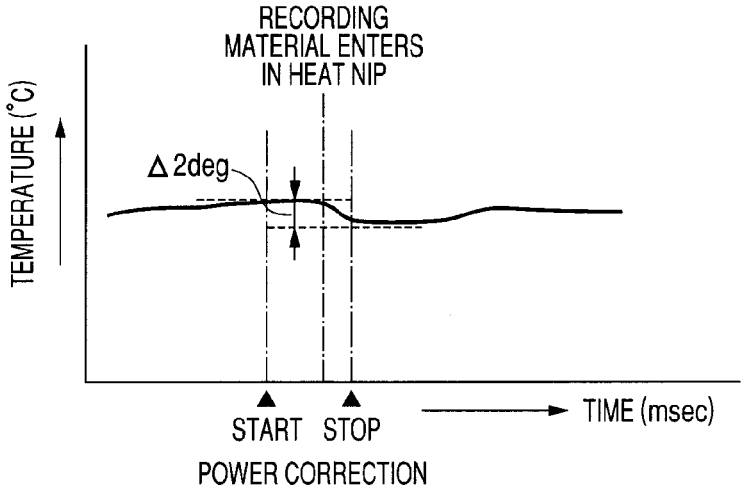
FIG. 14 is a graph illustrating a temperature of a heat film surface when the power correction is performed at an appropriate timing.
Figure 15:
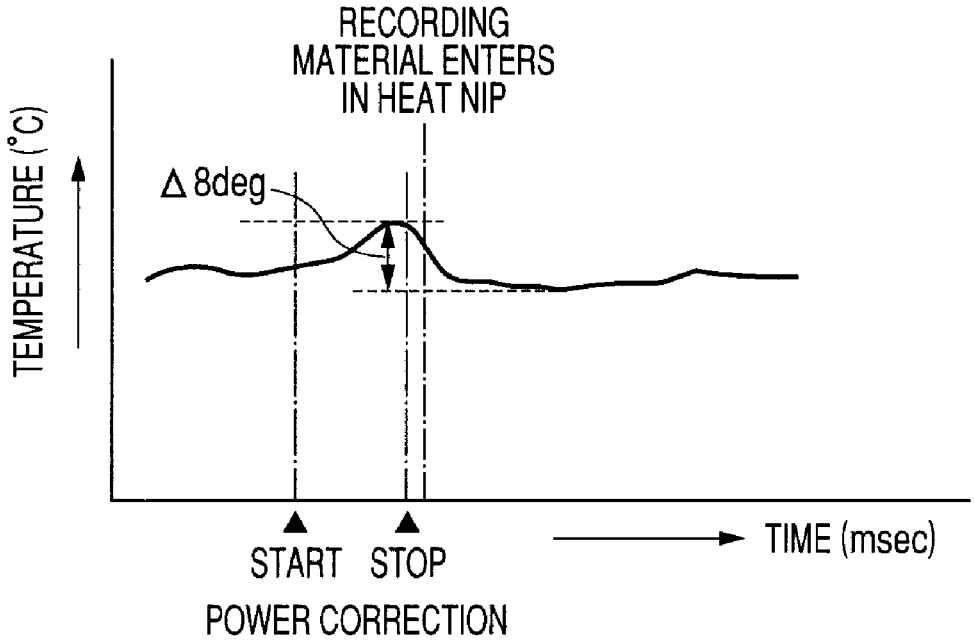
FIG. 15 is a graph illustrating a temperature of the heat film surface when the power correction is performed before the appropriate timing.
Figure 16:
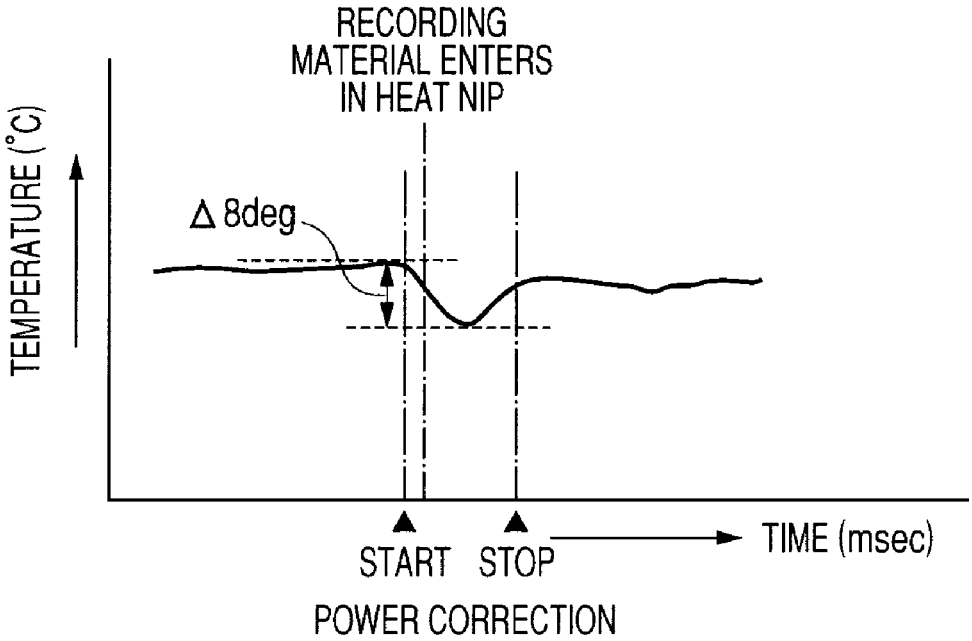
FIG. 16 is a graph illustrating a temperature of the heat film surface when the power correction is performed after the appropriate timing.

FIG. 9 is a flowchart illustrating an operation according to this exemplary embodiment. An actual correction operation is described based on the flowchart. The configuration of the image forming apparatus of the exemplary embodiment is similar to that of the first exemplary embodiment, and as illustrated in FIG. 1. The configuration of a heating device is similar to that of the first exemplary embodiment, as illustrated in FIGS. 2 to 4, and a similar description is therefore, avoided.

In FIG. 9, in Step S101, the image forming apparatus is started in a state in which a print signal is receivable after power is turned ON. In Step S102, a print command is received from the host computer (not shown). In Step S103, a paper mode is read from the print signal. In Step S104, the control circuit portion (CPU) 21 in the printer determines the correction supply power E2 (W) according to the paper mode as shown in Table 1. Then, in Step S105, the control circuit portion 21 drives the heater driving circuit portion 28, and starts start-up temperature control of the heater 16 in order to control the heat film 20 to have a predetermined temperature. In this case, control of supply power to the heater 16 is performed based on hybrid control using the power supply ratio patterns shown in Table 5. In this exemplary embodiment, the revising cycle of the power supply ratio is 80 milliseconds when the AC power is 50 Hz.

In Step S106, the heat film 20 is controlled near the predetermined temperature, and the start-up temperature control is finished. In Step S107, 190° C., which is the temperature for print temperature control, is set as a target temperature, and the temperature is controlled to the target temperature by the PID control with hybrid control.

Then, 180 milliseconds before the entry of the recording material, in Step S108, the supply power control is switched from hybrid control to phase control. In this case, in actuality, after the control circuit portion 21 has issued a switch command, the state is switched from hybrid control to phase control next time revised timing of the power supply ratio of the hybrid control arrives. Thus, actual switch timing varies between 180 milliseconds and 100 milliseconds before the recording material entry.

The state is switched 180 milliseconds before the recording material entry because switch timing from hybrid control to phase control must be timed to occur at a time before recording material entry corresponding to the revising cycle of the power supply ratio or more from the start time of power correction, as in the case of the first exemplary embodiment. More specifically, in the exemplary embodiment the revising cycle of the power supply ratio of hybrid control is 8 half waves=80 milliseconds (in the case of 50 Hz), and 80+100=180 milliseconds is set. Needless to say, as in the case of the first exemplary embodiment, this numerical value may be changed according to a frequency of the alternating current power.

Then, in Step S109, as soon as the state is switched to phase control, the processing stands by at a target temperature while performing PID control by using phase control for power control. The state has surely been switched to the phase control at least 100 milliseconds before the entry of the recording material. Thus, in Step S110, the PID control is stopped 100 milliseconds before the entry of the recording material, and predetermined power E2 (W) is output as the correction supply power determined in Step S104. In Step S111, the power E2 (W) is continuously supplied based on the phase control until 0 milliseconds after the entry of the recording material. In Steps S112 and S113, with a passage of 0 milliseconds after the entry of the recording material, the phase control is switched to hybrid control for updating the power supply ratio with the original 8 half waves set as one unit. Simultaneously, 190° C., which is a temperature for print temperature control, is set as the target temperature to resume the PID control.

In Step S114, the above-mentioned operation continues until the printing is finished. In Step S115, when the print job is finished, the temperature control is completed. This correction is performed based on Table 1 concerning the paper mode and the correction supply power E2 (W) provided in the control circuit portion (CPU) 21 of the printer.

As apparent from the foregoing, by using hybrid control combining wave number control with phase control, the revising cycle of the power supply ratio can be shortened while suppressing the harmonic current to a certain extent, and normal temperature control can be stabilized more.

Next, other exemplary embodiments of the present invention are described. Also in the following third to fifth embodiments, the power control portion switches, immediately before the leading edge of the recording sheet enters the fixing portion, the state of supplying power in the first power supply control mode to the state of supplying power in the second power supply control mode, then switches the state of supplying power in the second power supply control mode to the state of supplying power in the third power supply control mode, and further switches the state of supplying power in the third power supply control mode to the state of supplying power in the first power supply control mode.

The fixing portion fixes the unfixed toner image onto the recording material under a state in which power is supplied to the heater in the first power supply control mode.

Third Exemplary Embodiment

Figure 17:
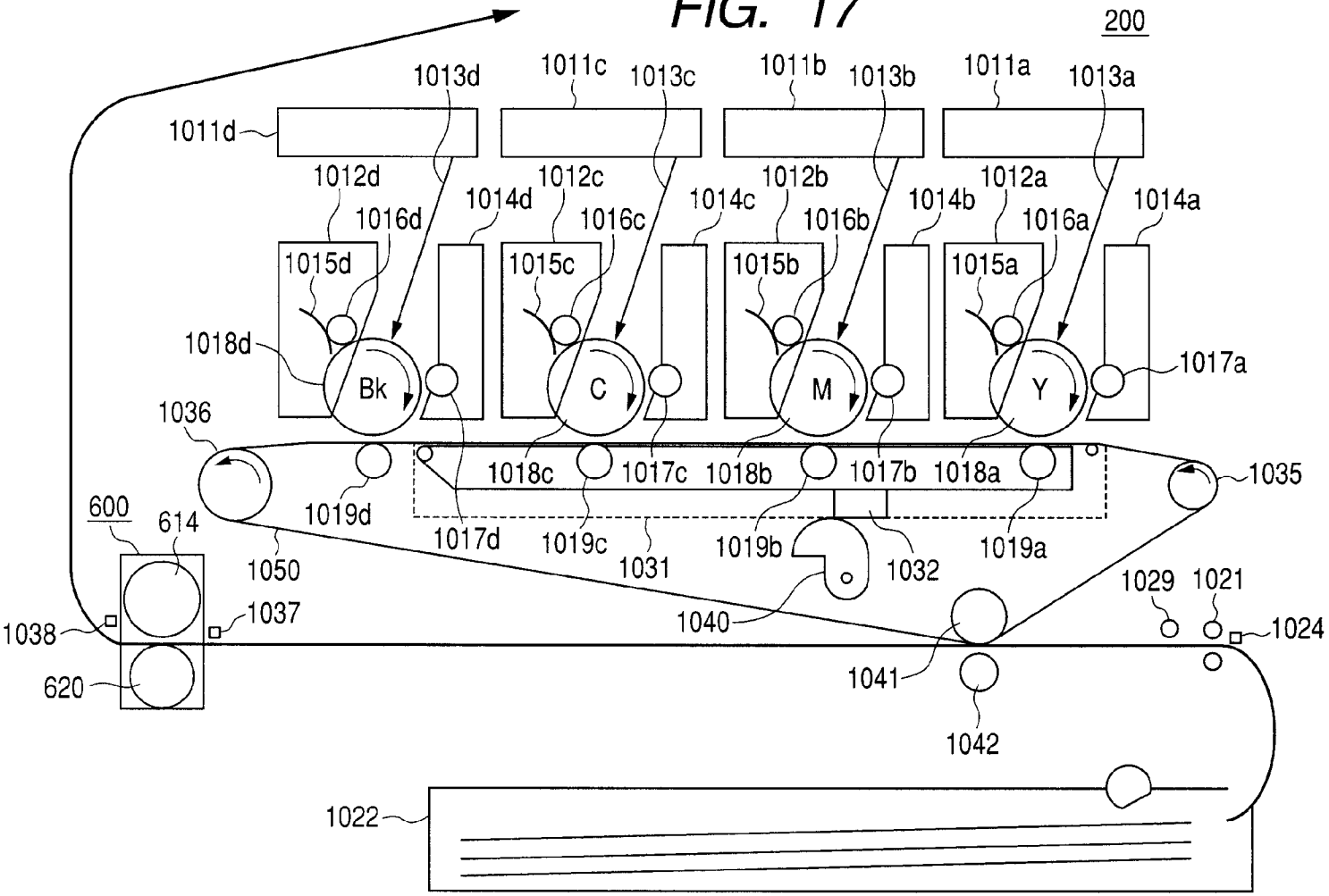
FIG. 17 schematically illustrates an image forming apparatus according to a third exemplary embodiment of the present invention.

FIG. 17 schematically illustrates a configuration of a color laser beam printer 200 of a tandem type.

The color laser beam printer 200 is a printer of a tandem type which includes an image forming portion for each of black (Bk), yellow (Y), magenta (M), and cyan (C) colors. The image forming portions for Y, M, C, and BK respectively include photosensitive drums 1018*a*, 1018*b*, 1018*c*, 1018*d*, primary chargers 1016*a*, 1016*b*, 1016*c*, 1016*d* for uniformly charging the photosensitive drums 1018*a*, 1018*b*, 1018*c*, 1018*d*, respectively, scanner units 1011*a*, 1011*b*, 1011*c*, 1011*d* for forming a latent image on the respective photosensitive drums 1018*a*, 1018*b*, 1018*c*, 1018*d* by applying laser beams 1013*a*, 1013*b*, 1013*c*, 1013*d* respectively, thereto, and developing devices 1014*a*, 1014*b*, 1014*c*, 1014*d* (developing rollers 1017*a*, 1017*b*, 1017*c*, 1017*d*) for respectively developing the latent images to be visible. The color laser beam printer 200 further includes primary transfer rollers 1019*a*, 1019*b*, 1019*c*, 1019*d* for transferring the visible images to an intermediate transfer belt 1050, a secondary transfer roller 1042 for transferring the transferred visible images from the intermediate transfer belt 1050 to a transfer sheet, and cleaning devices 1015*a*, 1015*b*, 1015*c*, 1015*d* for removing residual toner from the photosensitive drums 1018*a*, 1018*b*, 1018*c*, 1018*d* respectively. In FIG. 17, in order to differentiate components of similar functions constituting the image forming portions of the respective colors from one another, the reference numerals have subscripts a, b, c, and d.

Figure 18:
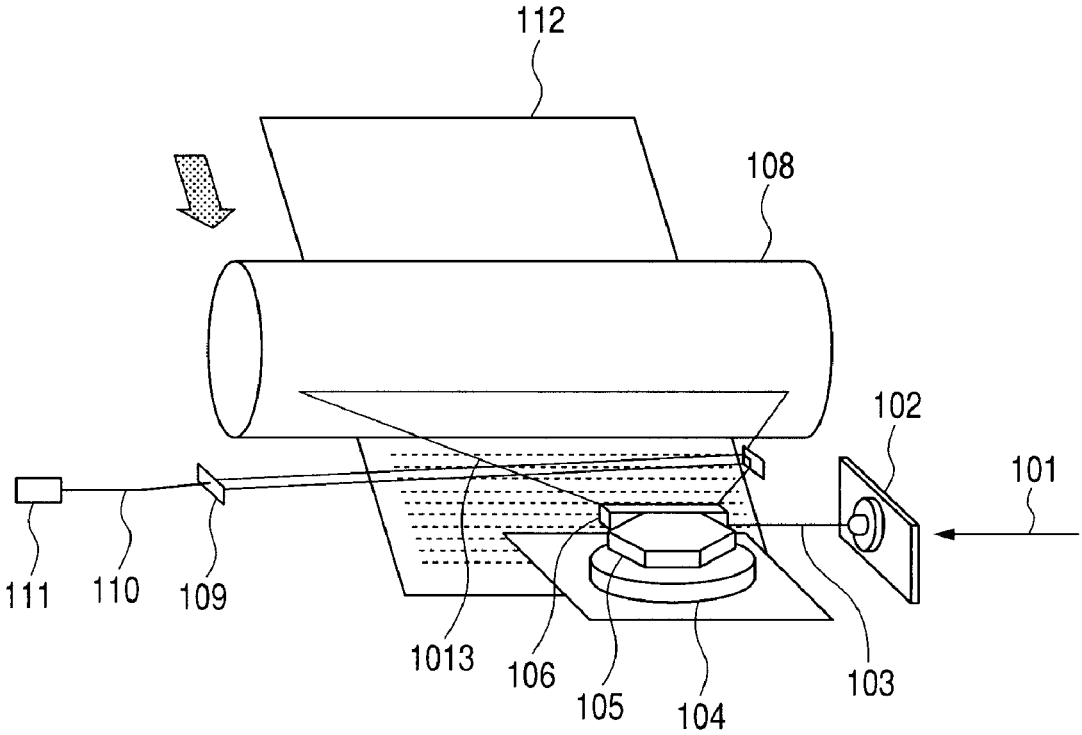
FIG. 18 illustrates a scanner unit.

The configuration of the scanner units 1011*a*, 1011*b*, 1011*c*, 1011*d* is described in detail. FIG. 18 illustrates the configuration of the scanner unit 1011.

When an image forming instruction is received from an external device, such as a personal computer, a control circuit in the color laser beam printer 200 converts image information into an image signal (VDO signal) 101 for turning ON/OFF a laser beam which is an exposure unit. The image signal (VDO signal) 101 is input to a laser unit 102 in each scanner unit 1011*a*-1011*d*. A laser beam 103 is ON/OFF modulated by the laser unit 102. A scanner monitor 104 steadily rotates a rotational polygon mirror 105. An image forming lens 106 focuses a laser beam 1013 deflected by the polygon mirror 105 on the photosensitive drum 108 which is a surface to be scanned and is a generic designation for the drums 1018*a*-1018*d* shown in FIG. 1.

With this configuration, the photosensitive drum 108 is horizontally scanned (scanned in a main scanning direction) with the laser beam 1013 modulated by the image signal 101, and a latent image is formed on the photosensitive drum 108.

A beam detection port 109 captures a beam from a slit incident port. The laser beam that has entered through the incident port is guided through an optical fiber 110 to a photoelectric conversion element 111. The laser beam converted into an electric signal by the photoelectric conversion element 111 is amplified by an amplifier circuit (not shown) to become a horizontal synchronizing signal.

Referring back to FIG. 17, a transfer sheet, which is a recording medium (recording material), fed from a cassette 1022 stands by at a registration roller 1021 in order to be fed through the apparatus at a timing controlled by an image forming portion control portion. In the vicinity of the registration roller 1021, a registration sensor 1024 for detecting a leading edge of the fed transfer sheet is disposed. The image forming apparatus control unit (not shown, referred to as "control unit" hereinafter) for controlling the image forming portions detects the time when the leading edge of the sheet has reached the registration roller 1021 based on a detection result of the registration sensor 1024. The control unit performs control so as to form an image of a first color (yellow in the illustrated example) on the photosensitive drum 1018*a*, which is an image bearing member, and to set a temperature of a heater of a fixing device 600 to a predetermined temperature.

The intermediate transfer belt 1050 is arranged to pass through each image forming portion. The intermediate transfer belt 1050 is driven to rotate integrally with the photosensitive drums 1018*a*-1018*d*. When a high voltage is applied as a primary transfer bias to the primary transfer roller 1019*a*, based on a reference position of the intermediate transfer belt 1050, a formed toner image of a first color, yellow, is sequentially transferred to the intermediate transfer belt 1050.

Similarly, an image of a second color (magenta in the illustrated example) is transferred to be-superimposed on the image of the first color formed on the intermediate transfer belt 1050 by controlling the timing of movement of the image leading edge of the first color, which is on the belt, by controlling the timing of movement of the belt 1050 and by controlling the timing of an image forming process of the second color. Similarly thereafter, an image of a third color (cyan in the illustrated example) and an image of a fourth color (black in the illustrated example) are sequentially transferred to be superimposed on the image on the intermediate transfer belt 1050 by taking into account the timing of each image forming process.

The secondary transfer roller 1042 for secondary-transferring the toner image formed on the intermediate transfer belt 1050 to the transfer sheet retreats to a position away from the intermediate transfer belt 1050 during image formation.

The transfer sheet, which is a transfer material, is fed from the cassette 1022, and stands by at the registration roller 1021 in order to time the feeding thereof in conjunction with the operations of the image forming portions. In the vicinity of the registration roller 1021, the registration sensor 1024 for detecting the leading edge of the fed transfer sheet is disposed. The control circuit conveys the transfer sheet standing-by at the registration roller 1021 again by taking into account the timing of the sheet leading edge position detected by the registration sensor 1024 and the leading edge position of an image formed in a sheet conveying direction (sub-scanning direction). In this case, the secondary transfer roller 1042 abuts against the intermediate transfer belt 1050 and, when a high voltage is applied as a secondary transfer bias to the secondary transfer roller 1042, the toner images of the four colors on the intermediate transfer belt 1050 are transferred collectively to the transfer sheet.

The transfer sheet having the toner images of the four colors transferred thereto passes through a nip portion of the fixing device 600 incorporating a heater. The toner is accordingly pressured and heated to be melted, thereby fixing the images on the transfer sheet. The conveying status of the transfer sheet before/after the fixing device 600 is monitored by a pre-fixing sensor 1037 and a fixing discharging sensor 1038. The transfer sheet having passed through the fixing device 600 is discharged out of the machine, thereby completing the full color image formation.

Figure 19:
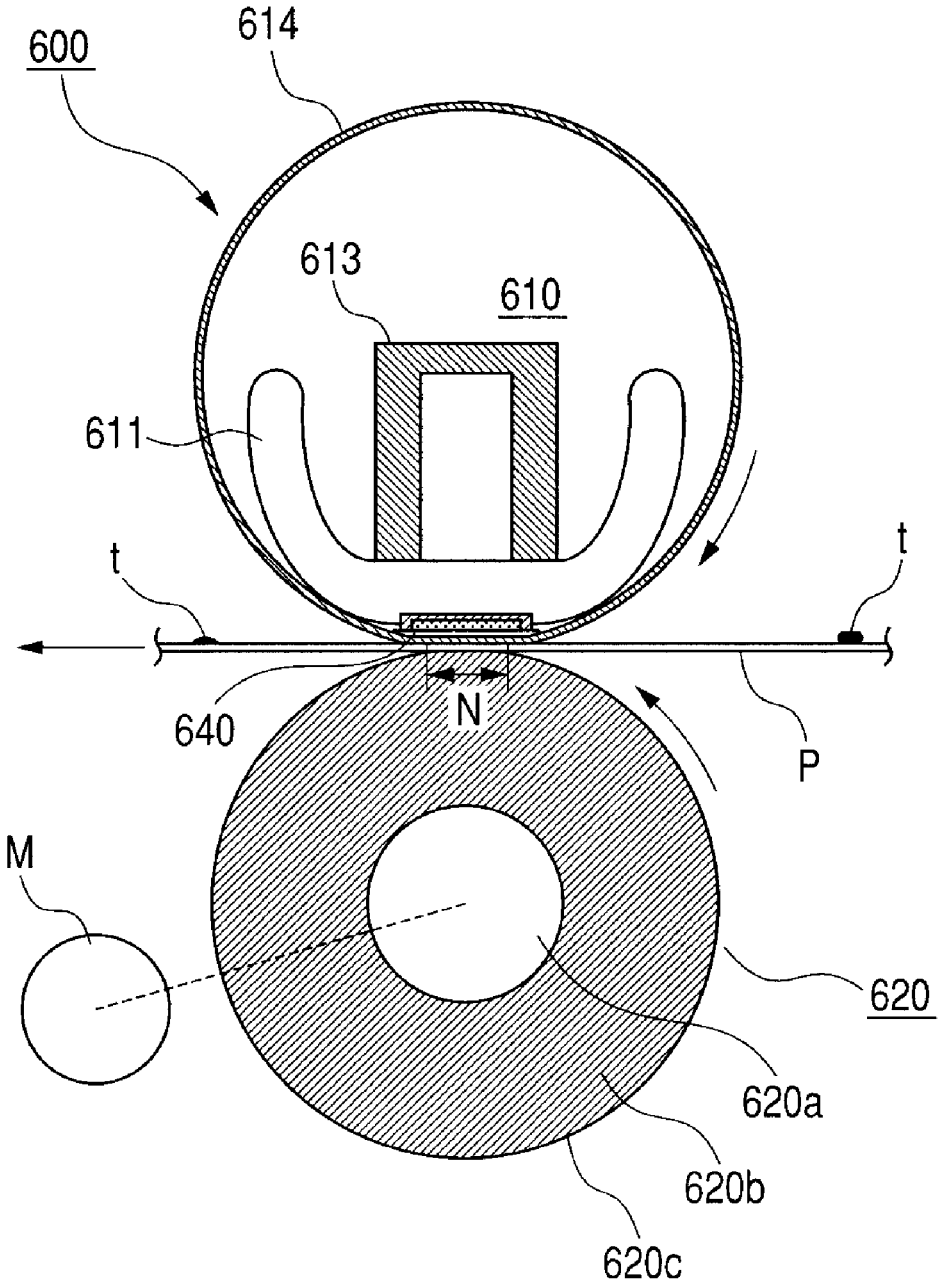
FIG. 19 schematically illustrates a fixing device according to the third exemplary embodiment of the present invention.

Next, as the fixing device 600, a film fixing device which uses a ceramic heater using ceramics for the heater as a heat source is described. FIG. 19 schematically illustrates the configuration of a fixing device in which a heater is applied as a ceramic heater 640.

A stay 610 includes a main body portion 611, U-shaped in cross section, which supports the ceramic heater 640 in an exposed state, and a pressure portion 613 for pressing the body portion toward a side of the fixing device containing an opposing pressure roller 620. In the ceramic heater, a heating element may be on a side opposed to the nip portion described below or on the nip portion side. A heat-resistive film 614 (abbreviated as "film" hereinafter) having a circular cross section is fitted around the stay 610.

The pressure roller 620 forms a pressure-contact nip portion (fixing nip portion) N by sandwiching the film 614 with the ceramic heater 640, and functions as a film outer surface contact driving unit for driving the film 614 to rotate. The pressure roller 620 also serving as the film driving roller includes a metal core 620*a*, an elastic member layer 620*b* formed of silicone rubber, and a mold releasing layer 620*c* of an outermost layer. The pressure roller 620 is pressed into contact with the surface of the ceramic heater 640 sandwiching the film 614 by a predetermined pressing force applied by a bearing unit/urging unit (not shown). The pressure roller 620 is driven to rotate by a motor M, thereby applying a conveying force to the film by a friction force between the pressure roller 620 and the outer surface of the film 614.

Figure 20A:
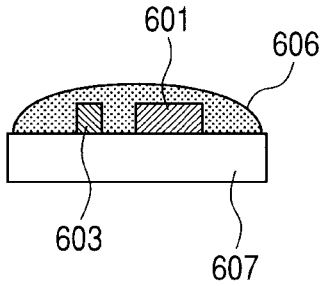
FIG. 20A is a sectional view illustrating a ceramic heater according to the third exemplary embodiment of the present invention.
Figure 20B:
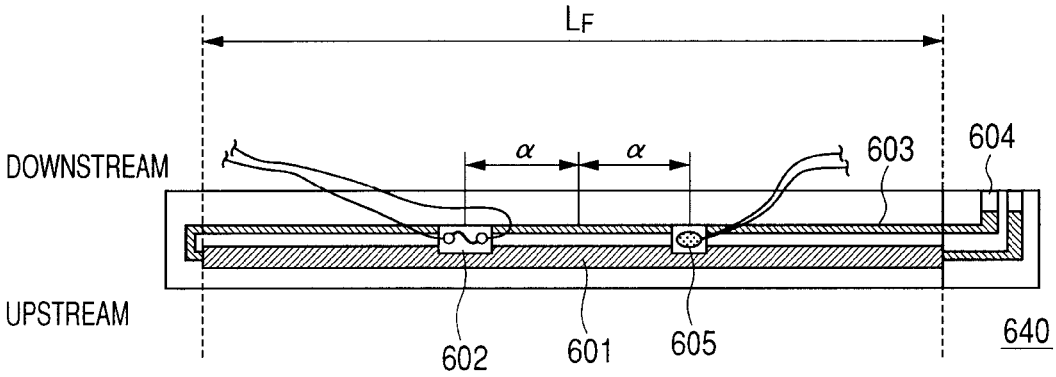
FIG. 20B illustrates a surface of the ceramic heater according to the third exemplary embodiment of the present invention.

FIGS. 20A and 20B schematically illustrate the positional relationship among the ceramic heater, a temperature detection element 605, and an excessive temperature increase prevention unit 602. FIG. 20A is a cross-sectional view of the ceramic heater, and FIG. 20B illustrates a surface where a heating element 601 is formed.

The ceramic heater includes a ceramic insulating substrate 607 of SiC, AlN, or $Al_2O_3$, the heating element 601 (power supply heating resistive layer) formed on the insulating substrate by paste printing, and a protective layer 606, such as glass, for protecting the heating element. Disposed on the protective layer are the temperature detection element 605, such as a thermistor, for detecting a temperature of the ceramic heater, and the excessive temperature increase prevention unit 602 for preventing an excessive temperature increase. The excessive temperature increase prevention unit 602 is, for example, a temperature fuse or a thermoswitch.

The heating element 601 includes a portion which generates heat when power is supplied, a conductive portion 603 connected to the heat-generation portion, and electrodes 604 to which power is supplied through a connector. The heating element 601 has a length substantially equal to a maximum passable recording sheet width LF. A HOT side terminal of an alternating current power source is connected to one of the two electrodes 604 through the excessive temperature increase prevention unit 602. The electrode portions are connected to a triac for controlling the heating element, and to a NEUTRAL terminal of the alternating current power source.

Figure 21:
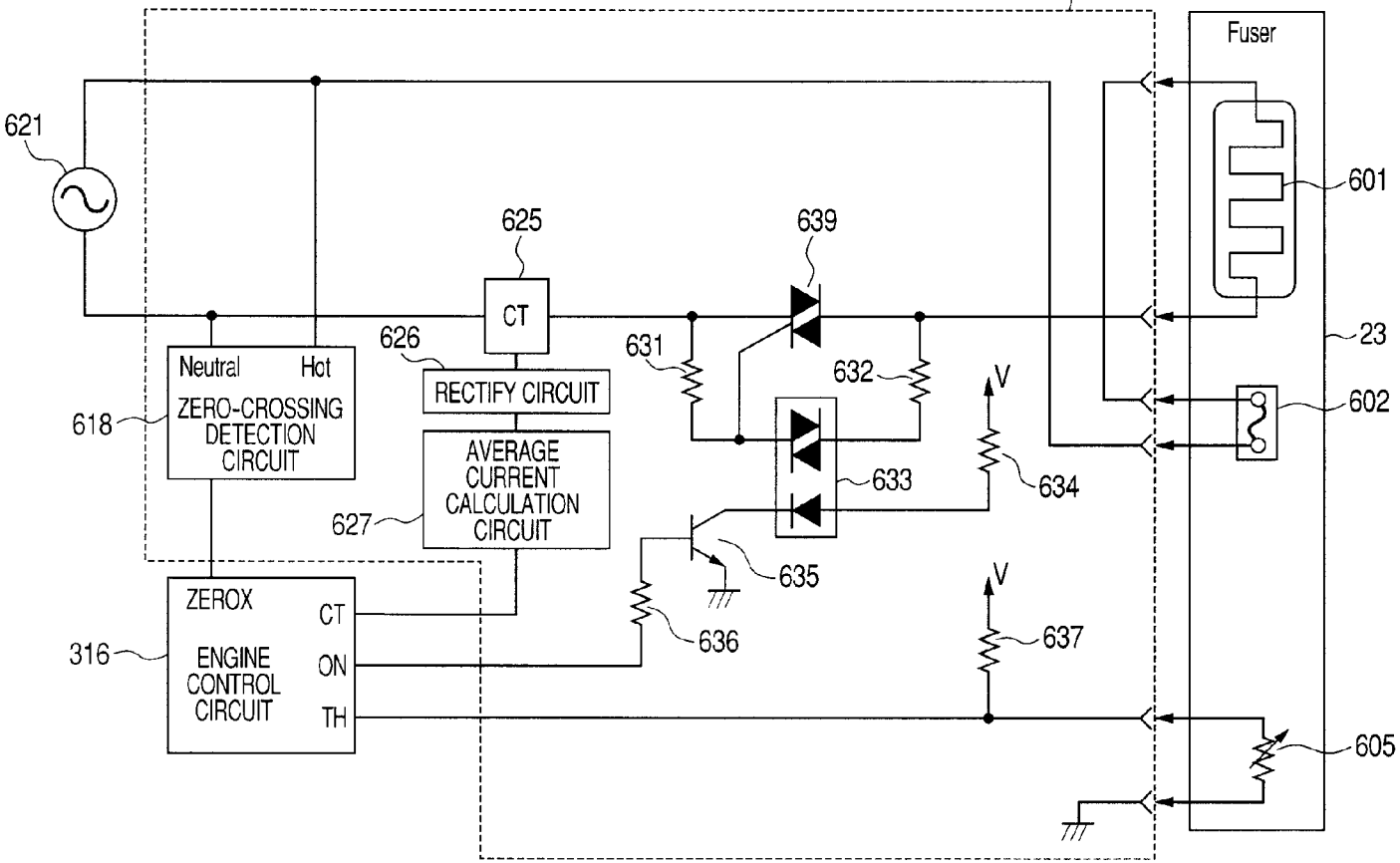
FIG. 21 illustrates a fixing driving circuit according to the third exemplary embodiment of the present invention.

FIG. 21 illustrates driving of the ceramic heater and the control circuit according to the present invention. The image forming apparatus is connected to a commercial alternating current power source 621. In the image forming apparatus, commercial power is supplied to the heating element 601 of the ceramic heater 640 through an AC filter (not shown), thereby generating heat from the heating element 601 of the ceramic heater.

The supplying of power to the heating element 601 is controlled ON/OFF by the triac 639. Resistors 631 and 632 are bias resistors for the triac 639, and a phototriac coupler 633 is a device for isolation between primary and secondary states. The triac 639 is turned ON by supplying power to a light emitting diode of the phototriac coupler 633. A resistor 634 limits a current of the phototriac, and is turned ON/OFF by a transistor 635. The transistor 635 operates based on an ON signal from an engine control circuit 316 through a resistor 636.

The alternating current power is input to a zero-crossing detection circuit 618 through the AC filter. The zero-crossing detection circuit 618 notifies the engine control circuit 316 of a state in which the commercial AC power is a voltage equal to or less than a threshold value as a pulse signal. Hereinafter, the signal transmitted to the engine control circuit 316 is referred to as a "zero-crossing signal". The engine control circuit 316 detects an edge of a pulse of the zero-crossing signal, and uses the signal as a timing signal for turning ON/OFF the triac 639.

The temperature detection element 605 for detecting a temperature of the ceramic heater including the heating element 601 is, for example, a thermistor temperature detection element, and is disposed on the ceramic heater 640 through an insulator having a dielectric voltage for securing an insulation distance from the heating element 601. The temperature detected by the temperature detection element 605 is detected as partial pressure between a resistor 637 and the temperature detection element 605, and input as a TH signal to an A/D port of the CPU in the engine control circuit 316. The temperature of the ceramic heater 640 is monitored as the TH signal by the engine control circuit 316. The engine control circuit 316 calculates the power to be supplied to the heating element 601 constituting the ceramic heater by comparing the temperature with a predetermined set temperature of the ceramic heater. When heater power control is performed based on the phase control described below, in correspondence with power to be supplied, the time for transmitting a heater ON-signal is calculated from an edge of the zero-crossing signal. In other words, among phase angles of an alternating current voltage, a phase angle for turning ON the heater is determined. Based on this set time, the engine control circuit 316 transmits, in synchronization with the zero-crossing signal, a heater driving signal to the transistor 635, and supplies power to the ceramic heater 640 at a predetermined timing. As described above, based on temperature information obtained by the temperature detection element 605, the engine control circuit 316 turns ON/OFF the supplying of power to the ceramic heater 640 and controls the temperature of the heating fixing device to a target temperature (within the range of the set temperature).

When a failure of the engine control circuit 316 causes thermal runaway of the heating element, and the excessive temperature increase prevention unit 602 exceeds a predetermined temperature, the excessive temperature increase prevention unit 602 is opened. Because of the opened excessive temperature increase prevention unit 602, the power supply path to the ceramic heater 640 is cut off, and the power supply to the heating element 601 is cut off, thereby providing protection when failures occur.

A current detection unit 625 which uses a current transformer detects a current flowing to the ceramic heater 640 of the fixing device 23. The current flowing to the ceramic heater 640 is converted into a voltage by the current transformer 625. The voltage is rectified to be a positive voltage by a rectify circuit 626, and then transmitted to the A/D port of the CPU (not shown) in the engine control circuit 316 as an analog signal corresponding to an average value of currents flowing to the ceramic heater 640 at an average current calculation circuit 627. The engine control circuit 316 constantly monitors currents, determines a phase angle not exceeding a predetermined maximum effective current by calculation based on the detected average current, and controls the maximum power to the ceramic heater 640.

Next, a method for controlling power to be supplied to the heater of the fixing device is described.

Figure 22:
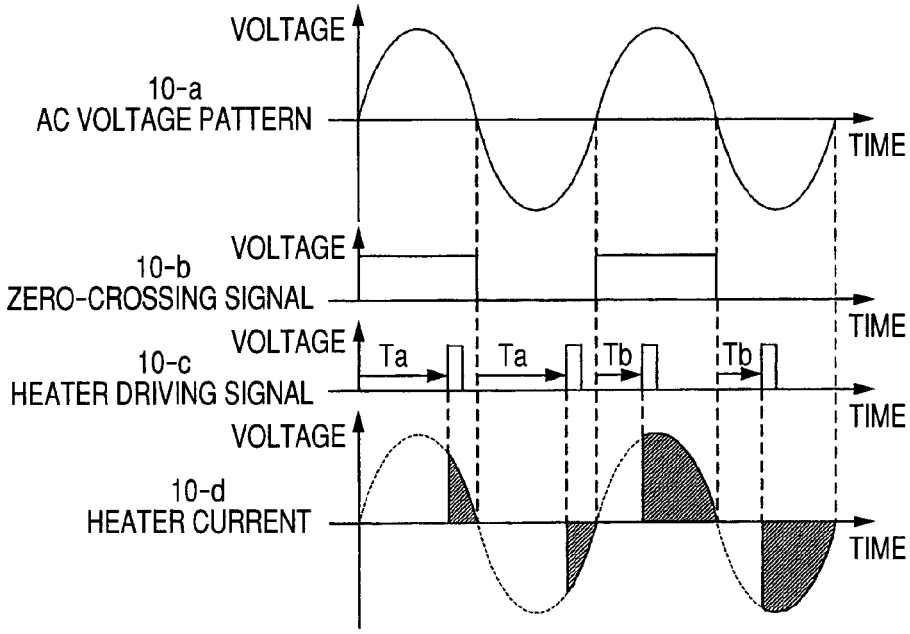
FIG. 22 illustrates phase control.

FIG. 22 illustrates an example of heater power control based on phase control. A zero-crossing signal (10-*b*) is switched in logic at points where an AC voltage pattern (10-*a*) is changed from positive to negative and from negative to positive. The zero-crossing signal exhibits timing where pulses are repeatedly transmitted to the engine control circuit 316 in a cycle T (=1/50 sec) of a commercial power frequency (50 Hz), and a pulse edge becomes 0 V (zero-crossing) at phase angles of 0° and 180° of voltage waveforms of the commercial power. When the engine control circuit 316 turns ON a heater driving signal (10-*c*) with the passage of time Ta after rising and falling edges, the triac 639 is turned ON to supply power to the ceramic heater 640 at a shaded portion of a heater current (10-*d*). After the heater has been turned ON, the triac 639 is turned OFF at a next zero-crossing point to turn OFF the power supply to the heater. Thus, by turning ON the heater driving signal with the passage of the time Ta after an edge of the zero-crossing signal again, equal power is supplied to the heater even at a next half wave.

When the heater driving signal is turned ON with the passage of time Tb different from the time Ta, the power supply period of time to the heater changes, and hence the supply of power to the heater can be changed. Thus, by changing the time of turning ON the heater driving signal after the edge of the zero-crossing signal for each half wave, the supply of power to the heater can be controlled. In order to increase the power supply to the heater, the timing for transmitting the heater driving signal after the edge of the zero-crossing signal is set earlier. In order to reduce the power supply, conversely, the timing for transmitting the heater driving signal after the edge of the zero-crossing signal is delayed.

By performing this control for each cycle or multiple cycles when necessary, the temperature of the ceramic heater 640 is controlled.

In the phase control, as illustrated in FIG. 22, power supply to the heater is turned ON in the midway of a half wave of the AC voltage pattern, and hence a current flowing to the heater suddenly rises, and the harmonic current flows. A waveform of a current flowing to the ceramic heater 640 is symmetrical positive and negative in one cycle in the illustrated example. The number of harmonic current components of the heater current is generally larger as a current rising amount is larger. Thus, the order of harmonic current which becomes a maximum at a phase angle of 90°, i.e., supply power of 50% is high. A rising edge of the current is generated for each half wave, and hence many harmonic currents flow. It is essential, therefore, to deal with harmonic wave regulation. Thus, in many cases, circuit components such as a filter are necessary. On the other hand, there is an advantage. Specifically, a current smaller than one half wave flows for each half wave, and hence the current changing amount is small. The changing cycle is short, and thus, its influence on flicker is small.

Figure 23:
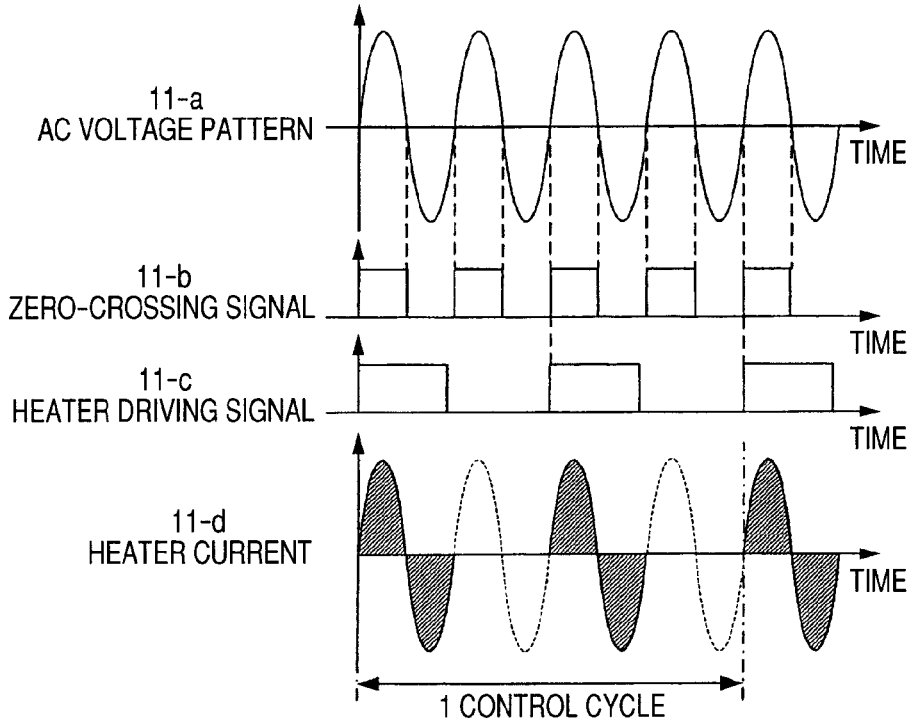
FIG. 23 illustrates wave number control.

FIG. 23 illustrates a pattern example of a heater power control table based on wave number control. In the wave number control, ON/OFF control (full power supply/no power supply control) is performed with the half wave of alternating current power set as a unit. Thus, for ON control, the heater driving signal is turned ON along with the edge of the zero-crossing signal. The supply of power to the heater is controlled by, for example, setting 8 half waves as one control cycle and changing the number of half waves to be turned ON within one control cycle. In FIG. 23, 4 half waves out of 8 half waves are turned ON, and hence the supply of power to the heater is 50%. Thus, by predefining heater control patterns obtained by dividing a range between 0% and 100% of heater supply power into 12 parts, the engine control circuit 316 can perform heater power control based on the heater control patterns. For ON control, two continuous half waves are turned ON. In the wave number control, ON/OFF control of the heater is always performed at zero-crossing. Thus, there is no sudden rising edge of a current unlike the case of the phase control, and the number of harmonic currents is very small. On the other hand, a current flows with a half wave set as a unit, and hence the current changing amount is large, and the changing cycle is long, greatly affecting flicker. Thus, by devising positions (control patterns) of half waves to be turned ON within one control cycle, the influence of a current on flicker of a fluctuation cycle is reduced as much as possible.

Figure 24:
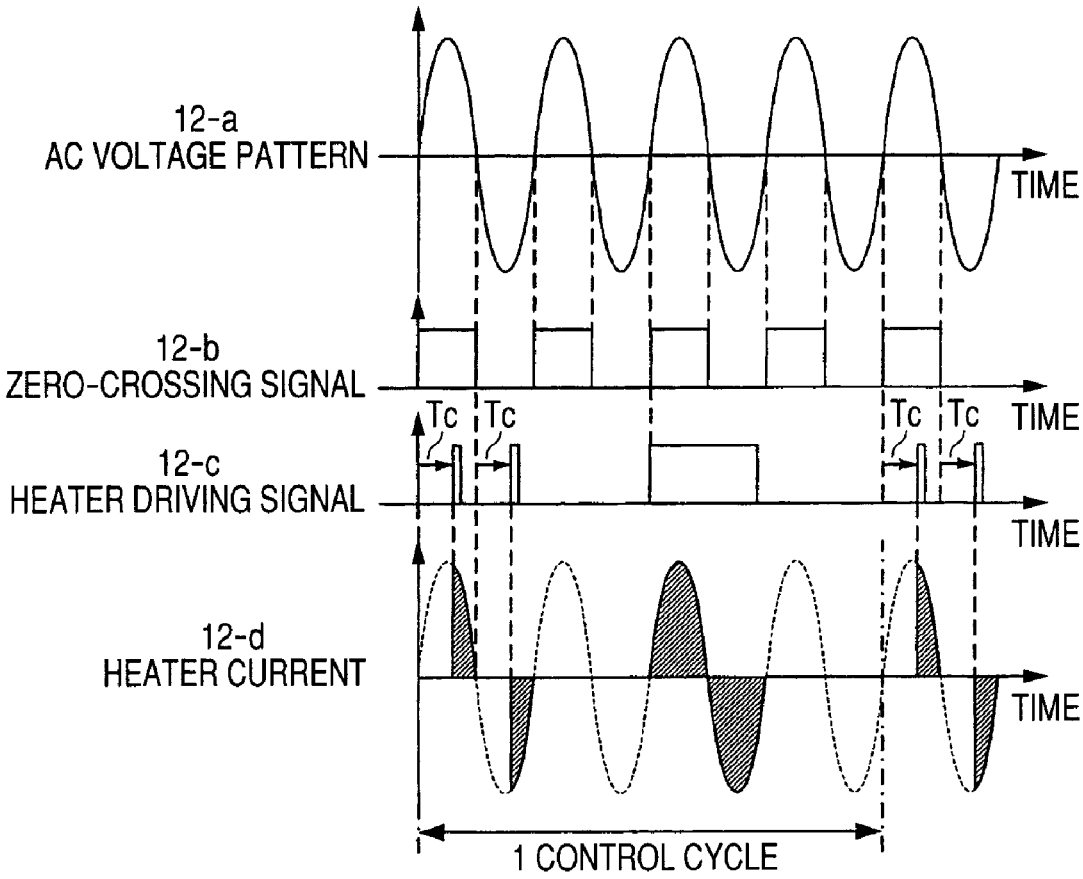
FIG. 24 illustrates control in which the phase control and the wave number control are combined according to the third exemplary embodiment of the present invention.
Figure 29A:
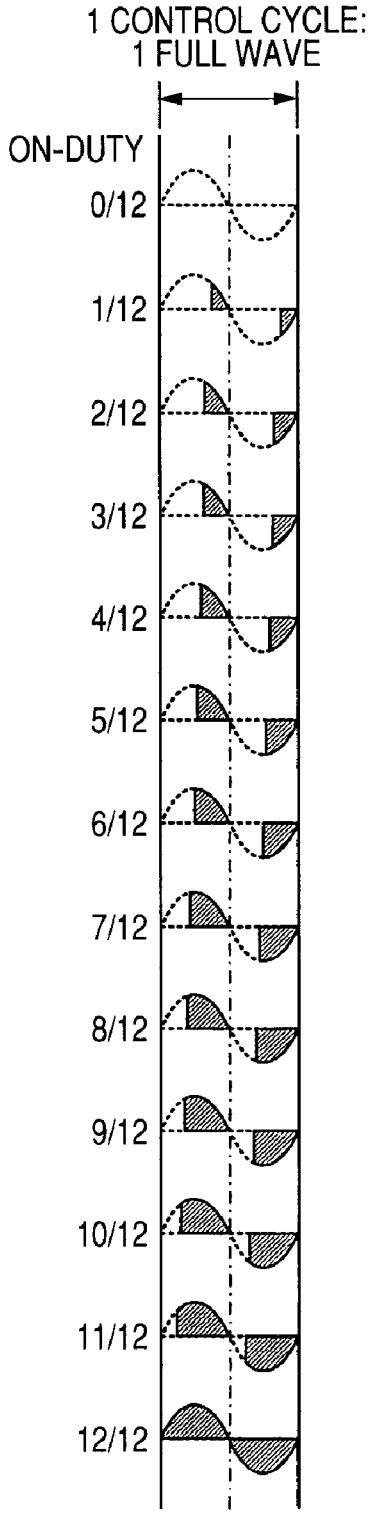
FIG. 29A illustrates Control Table 1 (phase control) according to the third exemplary embodiment of the present invention.
Figure 29B:
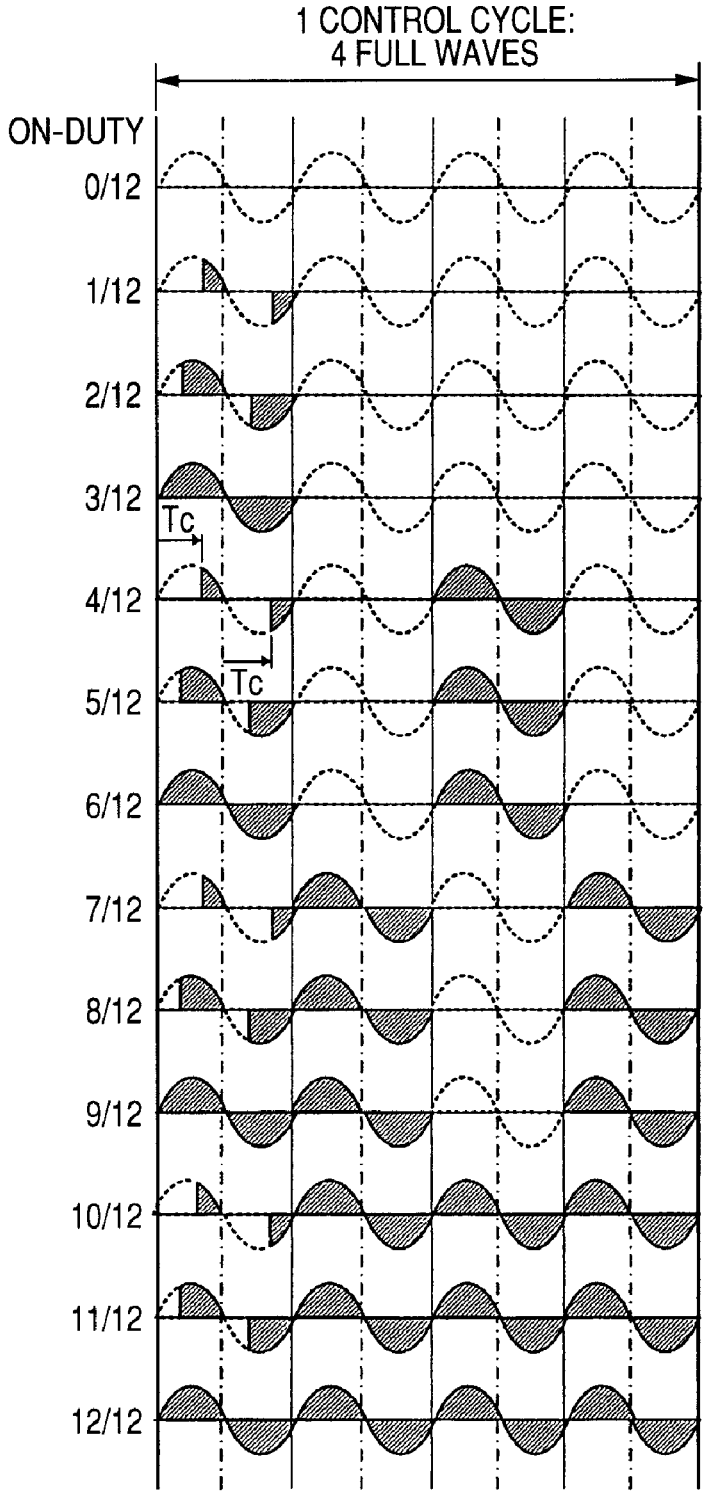
FIG. 29B illustrates Control Table 2 (combined control of a phase and a wave number) according to the third exemplary embodiment of the present invention.

FIG. 24 illustrates a pattern example of heater power control combining phase control and wave number control. The example of FIG. 24 shows a case where 8 half waves (multiple (N), N is an even number) constitute one control cycle, a part of the 8 half waves, that is 6 half waves, are controlled based on wave number control, 2 half waves are controlled based on phase control, and the heater supply power duty ratio is 4/12 (=33.3%). The engine control circuit 316 transmits, so that the half wave power duty ratio of a first wave and a second wave can be 33.3%, an ON signal to the transistor 635 at timing Tc to perform phase control, and turns ON 2 half waves out of the remaining 6 half waves based on wave number control while turning OFF all the other 4 half waves. As a result, a power of about 33.3% is supplied within one control cycle. Thus, by predefining a heater control table obtained by dividing the range between 0% and 100% of the heater supply power into 12 parts as illustrated in FIGS. 29A and 29B, the engine control circuit 316 can perform heater power supply control based on the heater power control pattern. As compared with the case of the wave number control, flicker is suppressed to a greater extent because phase control is provided. As compared with the phase control, harmonic current distortion is suppressed to a greater extent because the wave number control is provided.

Figure 25:
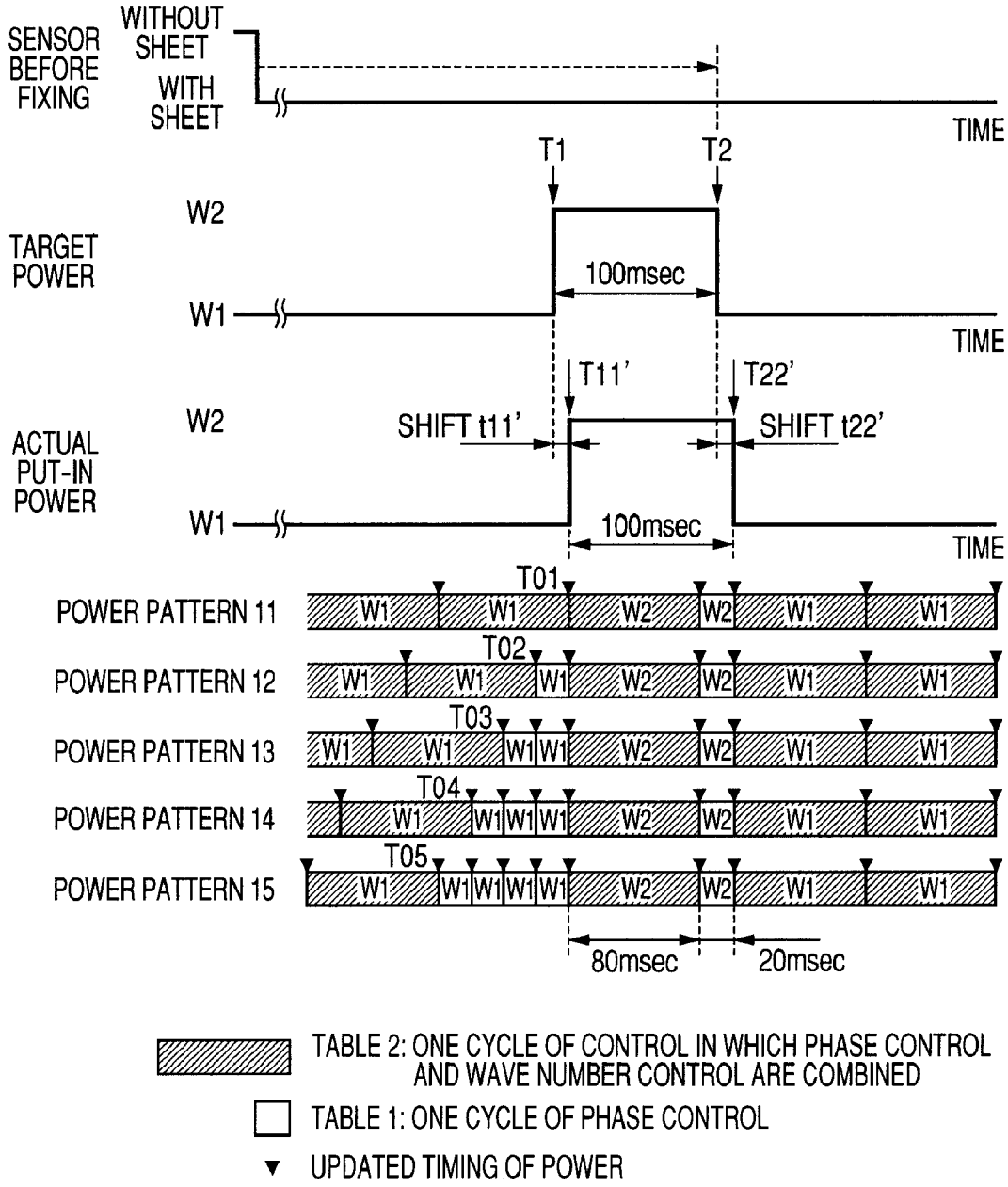
FIG. 25 is a timing chart illustrating fixing control according to the third exemplary embodiment of the present invention.
Figure 26:
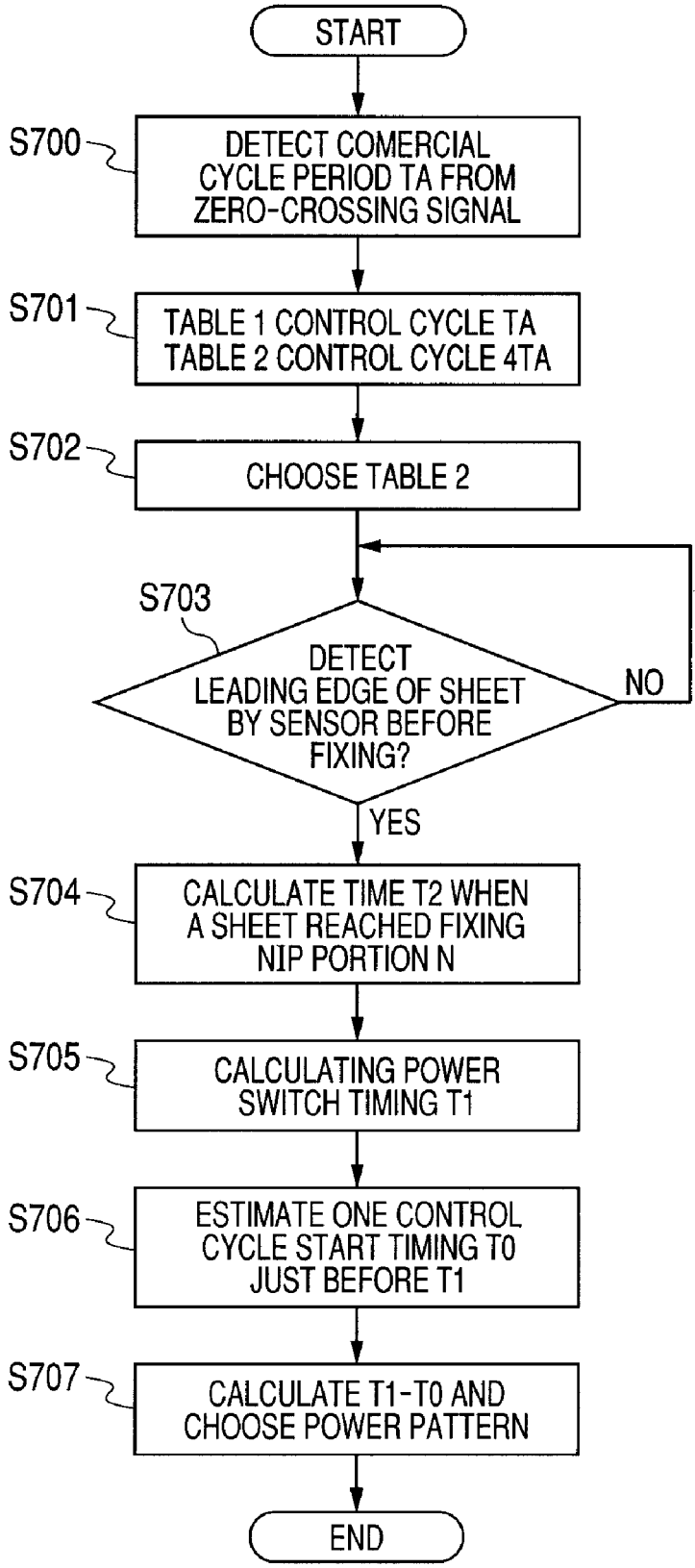
FIG. 26 is a flowchart illustrating the fixing control according to the third exemplary embodiment of the present invention.

Referring to FIGS. 25 and 26, an exemplary embodiment for reducing, as much as possible, the time difference between power switch timing in fixing temperature control and actual power switch timing, by using the heater power control combining the phase control and the wave number control, is described.

FIG. 25 is a timing chart of the third exemplary embodiment, and FIG. 26 is a flowchart of the third exemplary embodiment.

In the exemplary embodiment, a recording portion in an engine control circuit 316 records two types of heater power control tables (Table 1: phase control, and Table 2: control combining phase control and wave number control). The engine control circuit 316 switches the heater power control tables. Table 1 shows a second input power pattern (second power supply control mode), and Table 2 shows a first input power pattern (first power supply control mode). Table 1 shows a phase control pattern generally advantageous for flicker while disadvantageous for power harmonic wave distortion. The engine control circuit 316 controls the power set to be supplied to the heater by adjusting the phase angle for starting power supply to the heater for each cycle (1 full wave) of a commercial AC power cycle. Table 2 shows a heater power control pattern which combines phase control and wave number control so as to be advantageous for both of power harmonic wave distortion suppression and flicker suppression. With a "pattern combining the phase control and the wave number control" where 4 full waves constitute one control cycle, the temperature of the fixing heating device is controlled based on the temperature of the heater 640 detected by the temperature detection element 605. The engine control portion chooses an optimal heater power control pattern from Table 2 for each cycle (4 full waves).

In Step S700, the control circuit calculates in advance a cycle TA of commercial AC power based on a repeat cycle of a zero-crossing signal. For example, when a frequency of the commercial AC power is 50 Hz, its one cycle TA is 20 milliseconds. In this case, in Step S701, one control cycle (2 half waves, number M) of Table 1 is 20 milliseconds, and one control cycle (4 full waves) of Table 2 is 80 milliseconds.

In Step S702, in order to execute image formation by the color laser beam printer 200, the engine control circuit 316 chooses a heater power control pattern for increasing the temperature of the fixing heating device and performing pre-rotation from Table 2.

When the image forming operation is started, a transfer sheet having toner images of four colors secondarily transferred thereto from the intermediate transfer belt 1050 is conveyed, and a leading edge of the transfer sheet reaches the pre-fixing sensor on the upstream side, in Step S703, and the engine control circuit detects the position of the sheet leading edge based on a signal from the sensor. In Step S704, the engine control circuit calculates timing T2 when the transfer sheet reaches the fixing nip portion N at a detection timing of the leading edge conveying position of the pre-fixing sensor (conveying sensor).

In Step S705, the control circuit calculates timing T1 of a predetermined period of time (in this case 100 milliseconds) before the timing T2 when the sheet reaches the fixing nip portion N. Between the timing T1 and the timing T2, the control circuit sets the fixing power to power W2 higher than power W1 necessary for normal image formation (during fixing) (in other words, power is supplied in the third power supply control mode). For convenience of the description, an example of directly changing power to be supplied to the heater from a set value of the power W1 to a set value of the power W2 is described. In actuality, however, it is more practical to increase a set temperature value of the ceramic heater so as to correspond to a power increase than to increase power itself. When the set temperature value is increased, the power to be supplied to the heater can be increased as a result.

A reason for setting the power W2 is because an uneven temperature of the fixing heating device is reduced in order to achieve higher image quality. For example, a higher printing speed is accompanied by an increase in the amount of heat per unit time transferred from the fixing device to the transfer sheet, causing temperature unevenness of the fixing heating device. In particular, uneven brightness of an image for which high glossiness is required becomes conspicuous. When the transfer sheet is conveyed to the nip portion of the fixing device, the heat of the film (or roller) of the fixing device is captured by the sheet, and hence the film surface temperature exhibits a conspicuous reduction after one rotation of the film. Thus, an image fixed on the transfer sheet at the temperature reduced portion appears with uneven brightness thereof because of the insufficient fixing temperature. As measures to reduce uneven brightness of the image accompanying the uneven temperature of the fixing device, correction power superimposition control is performed, in which power is applied by superimposing, before the sheet reaches the nip portion of the fixing device, a power set in advance based on the assumption of the amount of heat captured by the sheet on target power during normal image formation.

In Step S706, the engine control circuit 316 calculates the timing T1 for increasing power to W2, and predicts timing T0 of an end of a power pattern of one control cycle revised immediately before the timing T1 based on a revising cycle of fixing power.

In the exemplary embodiment, combined use of Table 1 and Table 2 during power switching according to the difference between the power increase timing T1 and the timing T0 of the end of the power pattern of one control cycle immediately before the timing T1 is described.

Among the power patterns illustrated in FIG. 25, a square pattern indicates one control cycle of phase control (Table 1), and a rectangular pattern indicates one control cycle of control (Table 2) in which the phase control and the wave number control are combined. More specifically, those patterns schematically show the control tables illustrated in FIGS. 29A and 29B. Symbols W1 and W2 in the square and rectangular patterns indicate supply powers, and similar symbols indicate similar input powers. In other words, when W1 in the square pattern and W1 in the rectangular pattern indicate that supply powers (supply power ratios to the heater) are similar while tables are different between Table 1 and Table 2.

In Step S707, the engine control circuit 316 calculates T1−T0, and chooses one of power patterns illustrated in FIGS. 29A and 29B as follows according to a relationship between a result of the calculation and the cycle TA of commercial AC power:

| | |
|---|---|
| $0 \leqq T1 - T0 < 0.5 \times TA$ | power pattern 11 |
| $0.5 \times TA \leqq T1 - T0 < 1.5 \times TA$ | power pattern 12 |
| $1.5 \times TA \leqq T1 - T0 < 2.5 \times TA$ | power pattern 13 |
| $2.5 \times TA \leqq T1 - T0 < 3.5 \times TA$ | power pattern 14 |
| $3.5 \times TA \leqq T1 - T0 < 4.0 \times TA$ | power pattern 15 |

For example, when the power pattern 12 is chosen as a result of calculation, timing of an end of a power pattern of one control cycle of Table 2 revised immediately before the switch timing T1 is T02, and the power table is switched from 2 to 1 after the end of the control cycle (80 milliseconds). By performing phase control of one cycle (1 full wave) with power setting W1 of Power Table 1, the shift t11' during switching to the power W2 at the timing T1 can be minimized (within 20 milliseconds). In this case, the actual timing of switching to the power W2 is timing T11' obtained by adding t11'.

A period of setting the power W2 is, in this example, 100 milliseconds, and hence control is performed by combining one control cycle (20 milliseconds) of Table 1 and one control cycle (80 milliseconds) of Table 2. When setting of the power W2 is controlled only based on Table 2, its one control cycle is 80 milliseconds, and hence power can be set only at its integral multiples of 80 milliseconds, 160 milliseconds, and 240 milliseconds. In combination with Table 1, power setting can be controlled even if a power setting period is not necessarily an integral multiple of the control cycle of Table 2. More specifically, after the power W2 is set based on Table 2 at the timing T11', the table is switched from 2 to 1, and the power W2 is set based on Table 1. During setting of the power W2, the use order of the two tables may be reversed. Table 1 may be used first, and then switched to Table 2. When a necessary power setting period of the power W2 is, for example, 120 milliseconds, the control can be realized by additionally performing phase control of one cycle.

In the case of control for returning power from W2 to W1 at the timing T2, the shift t11' remains substantially as it is as shift t22', and hence power to be supplied to the heater is switched at timing T22' delayed by t22' from T2. Thus, the shift of power switch timing can be corrected as compared with the conventional case, and the necessary power can be supplied to the fixing device at the necessary timing.

The additional continued use period of time of the phase control based on Table 1 in the exemplary embodiment is short, about 100 milliseconds, and sufficiently small as compared with a filter time constant of a measurement device authorized according to a harmonic wave distortion standard. Thus, even if the control of the exemplary embodiment is performed, no problems occur because a measuring result of harmonic wave distortion is not deteriorated considerably. For flicker, no problems occur because of the control where the phase control advantageous for flicker is added during power switching.

The example of power control for increasing the power to the heater for a predetermined period of time before the transfer sheet reaches the fixing heating device has been described. However, the present invention is not limited to this power control. The invention can be applied effectively to the case of performing control for increasing/decreasing power at a predetermined timing in an image forming sequence. Needless to say, the invention can be applied effectively to not only the case of increasing the power for the predetermined period of time but also a case of increasing the value of a target temperature for performing temperature adjustment control for the fixing heating device.

The exemplary embodiment has been described by way of the case where the heater power control tables stored in the recording portion of the engine control circuit 316 are of two types. This is merely an example and the present invention can be applied even when multiple tables, i.e., three or more types of tables, are stored in the recording portion. For example, when a commercial AC voltage is high (e.g., 220 V to 240 V), relatively, in many cases, there are margins with respect to the flicker standard, and hence an optimal control table combining phase control and wave number control may be set according to the input voltage. In phase control, power supply timing to the heater may be calculated based on not a table but a relational expression between power supplied to the heater and a phase angle of commercial AC power for supplying power to the heater.

A reaching period of time T2 to the fixing nip portion N calculated based on a detection result of the engine control circuit 316, which indicates that a sheet is present, can be obtained by dividing the conveying distance between the pre-fixing sensor and the fixing nip portion by the conveying speed, and subtracting the output delay time of the pre-fixing sensor including chatter removal of the control portion. Reaching periods of time corresponding to some conveying speeds settable beforehand in the image forming apparatus may be pre-recorded in the recording portion of the control portion. By using the registration sensor 1024, the pre-fixing sensor 1037, and the fixing discharging sensor 1038 on the transfer sheet conveying path the speed including a very small speed fluctuation caused by an environmental change of the image forming apparatus may be calculated or calculated by interpolation.

Those supplementary descriptions apply to fourth and fifth exemplary embodiments described below.

As is apparent from the foregoing, according to the exemplary embodiment, in the fixing device which uses, as power supply control to the heater, control combining phase control and wave number control the time difference between the power switch timing in the fixing temperature control and the actual power switch timing can be reduced as much as possible. The control can be performed even if the power switching period is not necessarily an integral multiple of its control cycle. As a result, the fixing heating device can be provided, which can perform fixing power switching control at a more optimal timing as compared with the conventional case, and suppress an uneven temperature. An image forming apparatus can be provided, which can reduce uneven brightness and regulate both flicker and power harmonic wave distortion by including the fixing device discussed above.

Fourth Exemplary Embodiment

Figure 27:
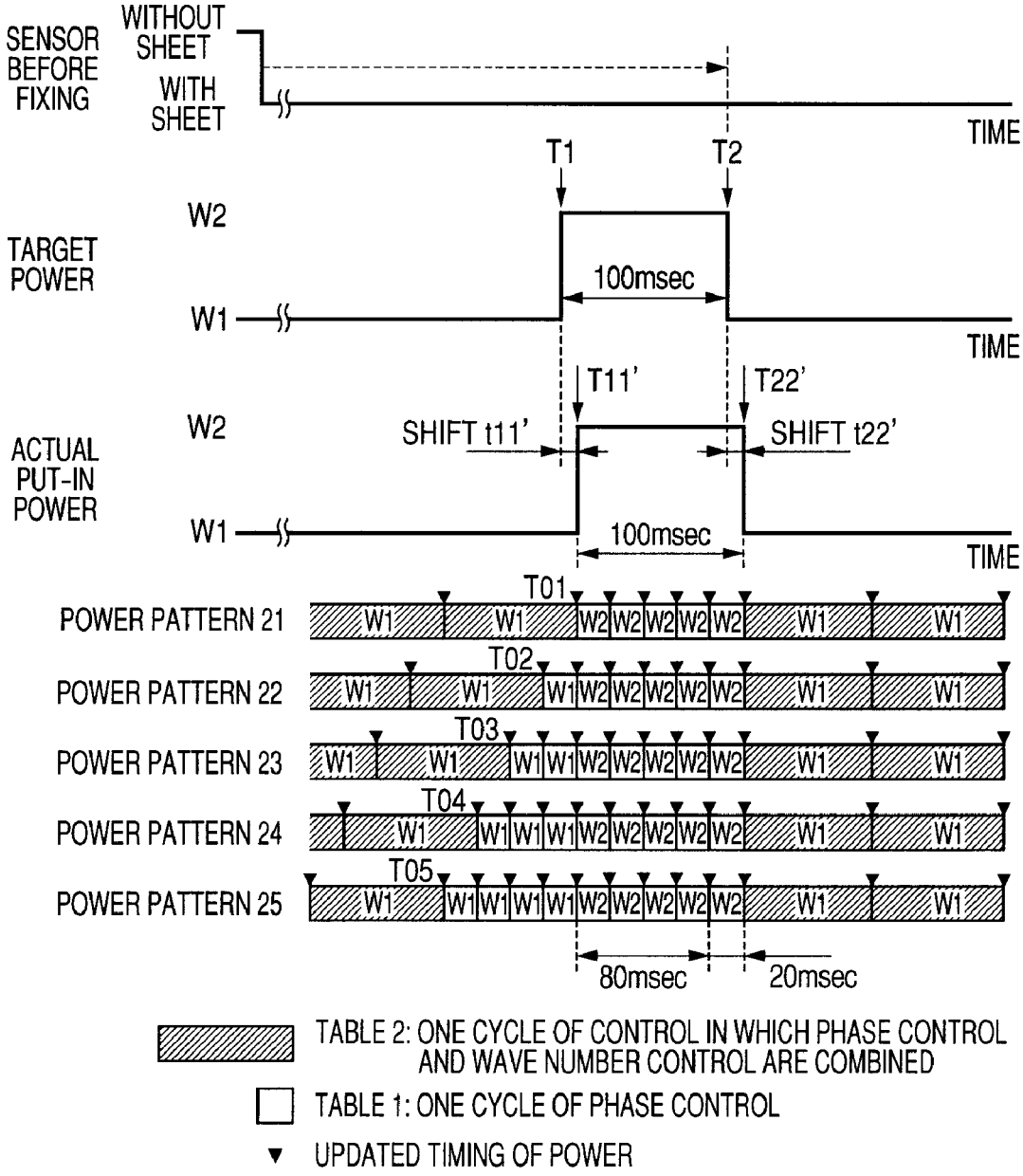
FIG. 27 is a timing chart illustrating fixing control according to a fourth exemplary embodiment of the present invention.

In the exemplary embodiment, in fixing power switching control, only Table 1 is used for a power increase period. FIG. 27 is a timing chart of the fourth exemplary embodiment.

Referring to FIG. 27, the fixing power switching control of the fourth exemplary embodiment is described. Components similar to those of the third exemplary embodiment are denoted by similar reference numerals used in the third exemplary embodiment in order to omit or simplify description.

Similarly to the third exemplary embodiment, an engine control circuit 316 calculates T1−T0, and chooses one of the power patterns illustrated in FIG. 27 as follows according to a result thereof:

| | |
|---|---|
| $0 \leqq T1 - T0 < 0.5 \times TA$ | power pattern 21 |
| $0.5 \times TA \leqq T1 - T0 < 1.5 \times TA$ | power pattern 22 |
| $1.5 \times TA \leqq T1 - T0 < 2.5 \times TA$ | power pattern 23 |
| $2.5 \times TA \leqq T1 - T0 < 3.5 \times TA$ | power pattern 24 |
| $3.5 \times TA \leqq T1 - T0 < 4.0 \times TA$ | power pattern 25 |

For example, when the power pattern 22 is chosen as a result of this calculation, the timing of an end of a power pattern of one control cycle of Table 2, revised immediately before the switch timing T1, is T02, and the power table is switched from 2 to 1 after the end of the control cycle (80 milliseconds). By performing phase control of one cycle (1 full wave) with power setting W1 of Power Table 1, the shift t11' during switching to power W2 at the timing T1 can be minimized (within 20 milliseconds). In this case, the actual timing of switching to the power W2 is timing T11' obtained by adding t11'.

A period of setting the power W2 is, in this example, 100 milliseconds, and hence control is performed in only five control cycles (100 milliseconds) of Table 1. One control cycle of Table 1 is 20 milliseconds, and hence power can be set at integral multiples of 20 milliseconds, 40 milliseconds, and 60 milliseconds. With the use of Table 1, power setting can be controlled even if a power setting period is not necessarily an integral multiple of the control cycle of Table 2. When a necessary power setting period of the power W2 is, for example, 120 milliseconds, the control can be realized by additionally performing phase control of one cycle.

In the case of control for returning power from W2 to W1 at timing T2, the shift t11' remains substantially as it is as shift t22', and hence power to be supplied to the heater is switched at timing T22' delayed by t22' from T2. Thus, the shift of power switch timing can be corrected as compared with the conventional case, and the necessary power can be supplied to the fixing device at necessary timing.

The additional continued use period of time of the phase control based on Table 1 in the exemplary embodiment is short, about 200 milliseconds, even in the case of the power pattern 25, and is sufficiently small as compared with a filter time constant of a measurement device authorized according to a harmonic wave distortion standard. Thus, even if the control of the exemplary embodiment is performed, no problems occur with a measuring result of harmonic wave distortion. For flicker, no problems occur because of the control where the phase control advantageous for flicker is added during power switching.

Thus, by employing the above-mentioned control, the fixing device can be provided, which can perform fixing power switching control at a more optimal timing as compared with the conventional case and suppress an uneven temperature, as in the third exemplary embodiment. The image forming apparatus can be provided, which can suppress a reduction in image quality and regulate both flicker and power harmonic wave distortion by including the fixing device noted above.

Fifth Exemplary Embodiment

Figure 28:
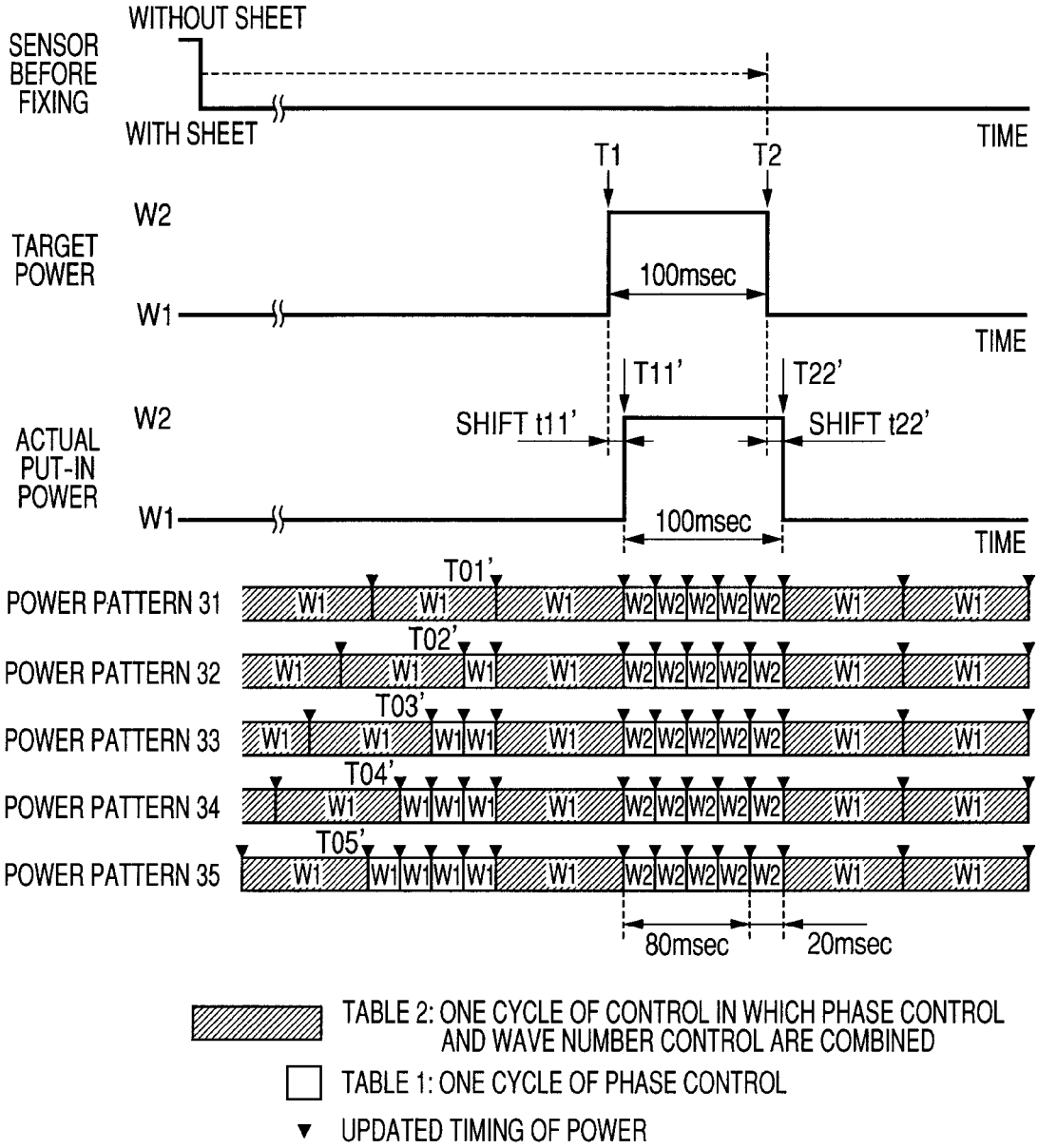
FIG. 28 is a timing chart illustrating fixing control according to a fifth exemplary embodiment of the present invention.

In the exemplary embodiment, in fixing power switching control, the timing for using, in combination, Table 1 and Table 2 during power switching is different. FIG. 28 is a timing chart of the fifth exemplary embodiment.

Referring to FIG. 28, the fixing power switching control of the fifth exemplary embodiment is described. Components similar to those of the third exemplary embodiment are denoted by similar reference numerals used in the third exemplary embodiment in order to omit or simplify description.

An engine control circuit 316 calculates timing T1 for increasing power to W2, and predicts the timing T0' of an end of a power pattern of a control cycle earlier by two control cycles revised immediately before the timing T1 based on a revising cycle of the fixing power.

In the exemplary embodiment, combined use of Table 1 and Table 2 during power switching according to the difference between the power increase timing T1 and the timing T0' of the end of the power pattern of the control cycle earlier by the two control cycles is described.

The engine control circuit 316 calculates T1−T0, and chooses one of power patterns illustrated in FIG. 28 as follows according to a result thereof:

| | |
|---|---|
| $4.0 \leqq T1 - T0 < 4.5 \times TA$ | power pattern 31 |
| $4.5 \times TA \leqq T1 - T0 < 5.5 \times TA$ | power pattern 32 |
| $5.5 \times TA \leqq T1 - T0 < 6.5 \times TA$ | power pattern 33 |
| $6.5 \times TA \leqq T1 - T0 < 7.5 \times TA$ | power pattern 34 |
| $7.5 \times TA \leqq T1 - T0 < 8.0 \times TA$ | power pattern 35 |

For example, when the power pattern 32 is chosen as a result of calculation the timing of an end of one control cycle of Table 2, revised earlier by two control cycles than the switch timing T1, is T02', and hence the power table is switched from 2 to 1 after the end of the control cycle (80 milliseconds). By performing phase control of one cycle (1 full wave) with power setting W1 of Power Table 1, the shift t11' during switching to power W2 at the timing T1 can be minimized (within 20 milliseconds). Then, returning to Table 2 again, the engine control circuit 316 performs combined control of phase control and wave number control of one cycle (4 full waves) with power setting W1 of Table 2. In this case, actual timing of switching to the power W2 is timing T11' obtained by adding t11'.

As in the fourth exemplary embodiment, a period of setting the power W2 is, in this example, 100 milliseconds, and hence control is performed only based on five control cycles (100 milliseconds) of Table 1. In the second exemplary embodiment, when the margin with respect to the harmonic wave distortion standard is reduced, the exemplary embodiment may be applied effectively.

Thus, by employing the above-mentioned control, the fixing heating device can be provided, which can perform fixing power switching control at a more optimal timing compared with the conventional case and suppress an uneven temperature as in the third exemplary embodiment. The image forming apparatus can be provided, which can suppress a reduction in image quality and regulate both flicker and power harmonic wave distortion by including the fixing device dicussed above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-140247, filed Jun. 11, 2009, and Japanese Patent Application No. 2009-140246, filed Jun. 11, 2009, which are, hereby incorporated by reference herein in their entirety.

What is claimed is:

1. An image forming apparatus, comprising:

a fixing portion that heat-fixes an unfixed toner image formed on a recording material onto the recording material, the fixing portion comprising:

an endless belt; and a heater that contacts an inner surface of the endless belt and generates heat by power supplied from a commercial alternating current power source;

a temperature detection element that detects a temperature of said fixing portion; and a power control portion that controls the power supplied from the commercial alternating current power source to the heater according to the temperature detected by the temperature detection element, wherein the power control portion is configured to set:

a first power supply control mode, with a predetermined number of half waves more than two continuous waves in an alternating current waveform set as one control cycle, for supplying power to the heater according to the detected temperature for each one control cycle;

a second power supply control mode, with a predetermined number of half waves equal to or less than the two continuous waves in the alternating current waveform set as one control cycle, for supplying power to the heater according to the detected temperature for each one control cycle; and a third power supply control mode for supplying predetermined power to the heater, wherein the power control portion switches, before a leading edge of the recording material enters the fixing portion, a state of supplying the power in the first power supply control mode to a state of supplying the power in the second power supply control mode, then switches the state of supplying the power in the second power supply control mode to a state of supplying the power in the third power supply control mode, and further switches the state of supplying the power in the third power supply control mode to the state of supplying the power in the first power supply control mode, and wherein the fixing portion fixes the unfixed toner image onto the recording material in the state of supplying the power to the heater in the first power supply control mode.

2. An image forming apparatus according to claim 1, wherein the first power supply control mode comprises a mode of performing one of wave number control or combined wave number control and phase control, and the second power supply control mode comprises a mode of performing the phase control.

3. An image forming apparatus according to claim 1, wherein the timing at which the power control portion switches the mode from the first power supply control mode to the second power supply control mode is a timing prior to a time period corresponding to the one control cycle of the first power supply control mode before timing for starting supplying the predetermined power.

4. An image forming apparatus according to claim 1, wherein the timing for starting the supply of the predetermined power and the timing for switching from the first power supply control mode to the second power supply control mode are set based on the entry timing of the recording material into the fixing portion.

5. An image forming apparatus according to claim 1, wherein the fixing portion further comprises a pressure roller that forms a fixing nip portion that fixing the recording material having the unfixed toner image formed thereon, together with the heater through the endless belt.

* * * * *